US008246071B2

(12) United States Patent
Thompson, III et al.

(10) Patent No.: US 8,246,071 B2
(45) Date of Patent: Aug. 21, 2012

(54) SKI BINDINGS

(75) Inventors: Cary A. Thompson, III, Basalt, CO (US); David Durrance, Carbondale, CO (US)

(73) Assignee: Cary A. Thompson, III, Basalt, CO (US)

( * ) Notice: Subject to any disclaimer, the term of this patent is extended or adjusted under 35 U.S.C. 154(b) by 1043 days.

(21) Appl. No.: 12/191,065

(22) Filed: Aug. 13, 2008

(65) Prior Publication Data

US 2009/0066060 A1 Mar. 12, 2009

Related U.S. Application Data

(60) Provisional application No. 60/955,501, filed on Aug. 13, 2007, provisional application No. 60/956,143, filed on Aug. 16, 2007.

(51) Int. Cl.
*A63C 9/08* (2006.01)

(52) U.S. Cl. ..... 280/611; 280/629

(58) Field of Classification Search ..... 280/607, 280/613, 617, 618, 619, 620, 623, 626, 629, 280/633, 634, 14.21
See application file for complete search history.

(56) References Cited

U.S. PATENT DOCUMENTS

| | | | | |
|---|---|---|---|---|
| 3,210,090 | A * | 10/1965 | Keeling et al. | 280/620 |
| 3,612,557 | A * | 10/1971 | Berlenbach | 280/629 |
| 3,672,695 | A * | 6/1972 | Baukhage | 280/620 |
| 4,165,887 | A | 8/1979 | Bunn, Jr. | |
| 4,316,618 | A | 2/1982 | Sampson | |
| 4,512,594 | A * | 4/1985 | Eyre | 280/614 |
| 5,207,446 | A | 5/1993 | Arnulf et al. | |
| 5,324,063 | A | 6/1994 | Locantro | |
| 5,947,508 | A | 9/1999 | Graf et al. | |
| 6,299,193 | B1 | 10/2001 | Parris et al. | |
| 6,308,979 | B1 | 10/2001 | Ludlow | |
| 6,336,650 | B1 | 1/2002 | Alspaugh | |
| 6,575,489 | B1 * | 6/2003 | White | 280/613 |
| 7,197,968 | B2 | 4/2007 | Bubel et al. | |
| 7,201,392 | B2 | 4/2007 | King | |
| 2002/0101060 | A1 | 8/2002 | Gorza et al. | |
| 2003/0155742 | A1 | 8/2003 | Riedel et al. | |
| 2005/0212259 | A1 | 9/2005 | Leitner | |
| 2006/0087102 | A1 | 4/2006 | Coles et al. | |
| 2007/0126203 | A1 | 6/2007 | Giffin et al. | |

FOREIGN PATENT DOCUMENTS

JP 2002224261 A 8/2002

OTHER PUBLICATIONS

Blizzard Skis, Ski, Sep. 2009, p. 33, #5, "Fit for a King" Slider binding.
International Search Report and Written Opinion for PCT/US2008/073032 dated Mar. 6, 2009.

* cited by examiner

*Primary Examiner* — J. Allen Shriver, II
*Assistant Examiner* — Bridget Avery
(74) *Attorney, Agent, or Firm* — Scott E. Kamholz; Peter K. Sollins; Foley Hoag LLP

(57) ABSTRACT

Telemark ski bindings may incorporate a rotational decoupler as disclosed. When exposed to subthreshold torques during normal use, the ski boot will remain rotationally coupled to (i.e, cannot rotate relative to) the ski. When exposed to threshold- or suprathreshold torques, such as when a skier loses control, the ski boot will become rotationally decoupled from (i.e., can rotate relative to) the ski, thereby protecting the skier's legs from the excessive torque and resulting leg injury. Also disclosed are tracked/railed alpine touring and telemark bindings, as well as methods for interchanging such bindings on railed/tracked skis.

19 Claims, 22 Drawing Sheets

SKI BINDINGS

CROSS-REFERENCE TO RELATED APPLICATIONS

This application claims the benefit of U.S. Provisional Application No. 60/955,501, filed Aug. 13, 2007, and of U.S. Provisional Application No. 60/956,143, filed Aug. 16, 2007, both of which are hereby incorporated herein by reference.

SUMMARY

Telemark ski bindings may incorporate a rotational decoupler as disclosed. When exposed to subthreshold torques during normal use, the ski boot will remain rotationally coupled to (i.e, cannot rotate relative to) the ski. When exposed to threshold- or suprathreshold torques, such as when a skier loses control, the ski boot will become rotationally decoupled from (i.e., can rotate relative to) the ski, thereby protecting the skier's legs from the excessive torque and resulting leg injury.

Also disclosed are tracked/railed alpine touring and telemark bindings, as well as methods for interchanging such bindings on railed/tracked skis.

BRIEF DESCRIPTION OF THE DRAWINGS

FIG. 3*a* shows the system below a threshold torque. FIG. 3*b* shows the system decoupled after being exposed to a torque above the threshold.

DETAILED DESCRIPTION

1. Rotational Decoupler

FIGS. 1-12*b* depict various embodiments and features of telemark bindings that are capable of rotationally decoupling from a ski 4 under sufficiently high torque. When a skier is skiing normally, he or she will expose the binding to torques below the set threshold torque. When the skier falls, the set threshold torque may be exceeded, and the ski will become free to rotate relative to the skier's leg without twisting the toepiece. The ski boot, binding and ski will nonetheless stay attached, thereby providing some protection from joint injury, while eliminating the need for the skier to locate and reattach a ski disconnected during a fall.

Figure 1:
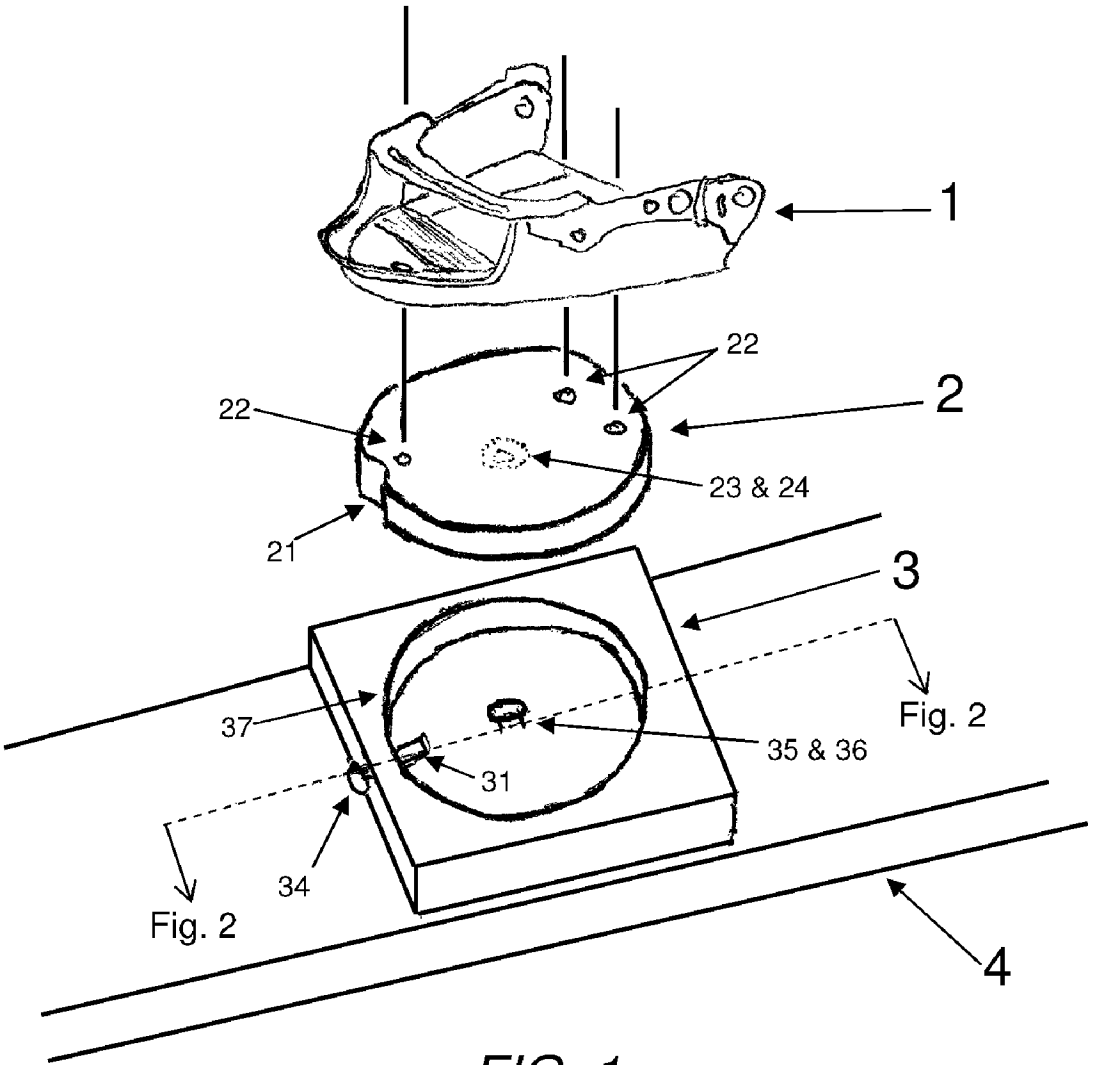
FIG. 1 shows a partially exploded view of an exemplary embodiment of a binding.
Figure 2:
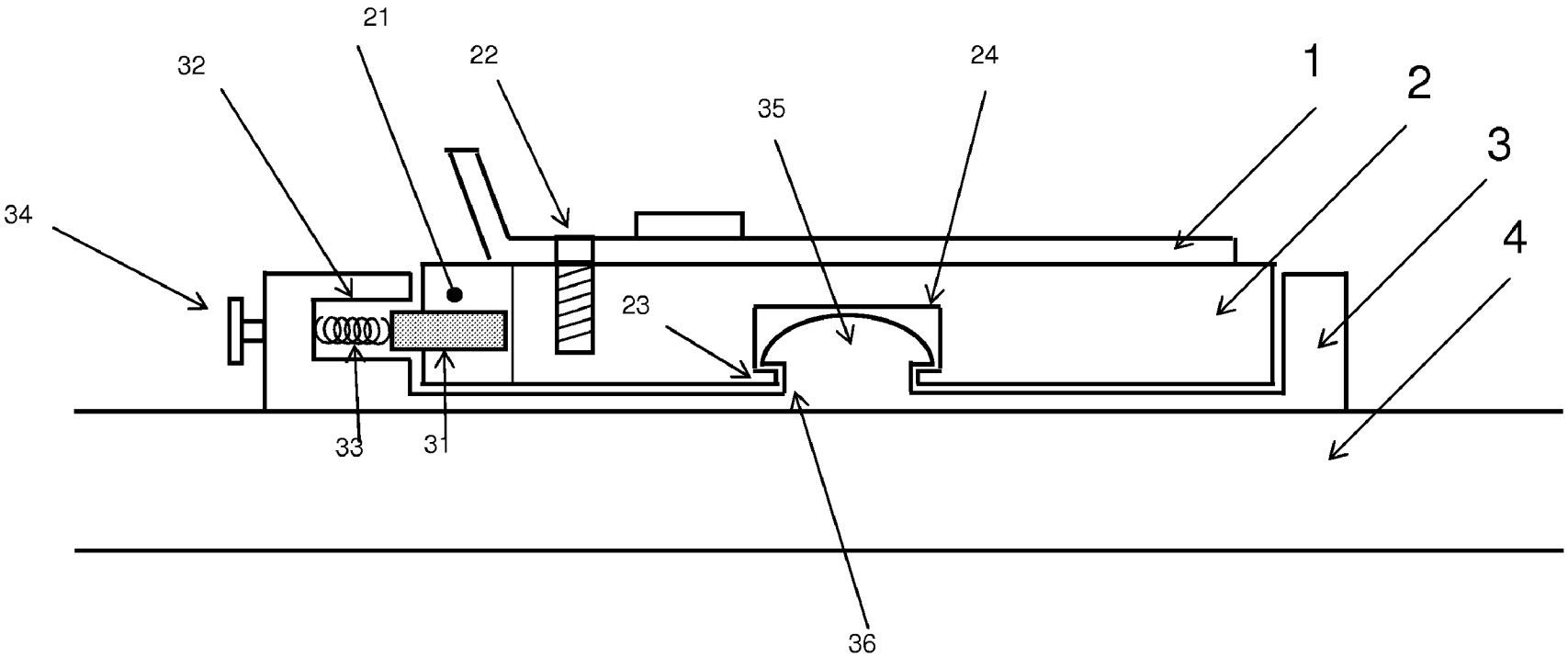
FIG. 2 shows the cross-section indicated in FIG. 1 of the same embodiment.

FIG. 1 shows a partially exploded view of one embodiment of a telemark binding, shown mounted on a ski. FIG. 2 shows the indicated cross-section of the same embodiment. FIG. 3 shows two overhead views of the same embodiment.

As shown in FIGS. 1, 2 and 3, a telemark binding toepiece 1, designed to attach to a telemark ski boot, is attached to an upper coupler 2 so that the toepiece 1 can neither substantially translate nor substantially rotate relative to the upper coupler 2. The toepiece 1 may be attached to the upper coupler 2 with screws and screw-holes 22 as indicated in FIG. 1, or in any other suitable manner.

Positioned below the upper coupler 2 is a lower coupler 3. In the depicted embodiment, the upper coupler 2 fits into an blind hole 37 in the lower coupler 3. The upper coupler 2 attaches to the lower coupler 3 so as to allow the upper coupler 2 to rotate relative to the lower coupler 3, but not to translate substantially relative to the lower coupler 3. A wide variety of arrangements that achieve this result would be sufficient, and two such embodiments are shown, one in FIG. 1 and the other in FIG. 4. In both embodiments, the upper coupler 2 is kept from translating horizontally by the walls of the opening 37 in the lower coupler 3.

In the embodiment shown in FIG. 1, the upper coupler 2 is kept from substantially translating vertically by a bulb 35 that fits into a blind bulb-receiving hole 24 in the bottom of the upper coupler 2. The bulb 35 has a shoulder 36 which mates with a lip 23 at the edge of the hole 24. The shoulder 36 and the lip 23 mate with enough clearance to allow the upper coupler 2 to rotate relative to the lower coupler 3 without allowing any substantial vertical translation.

Figure 4:
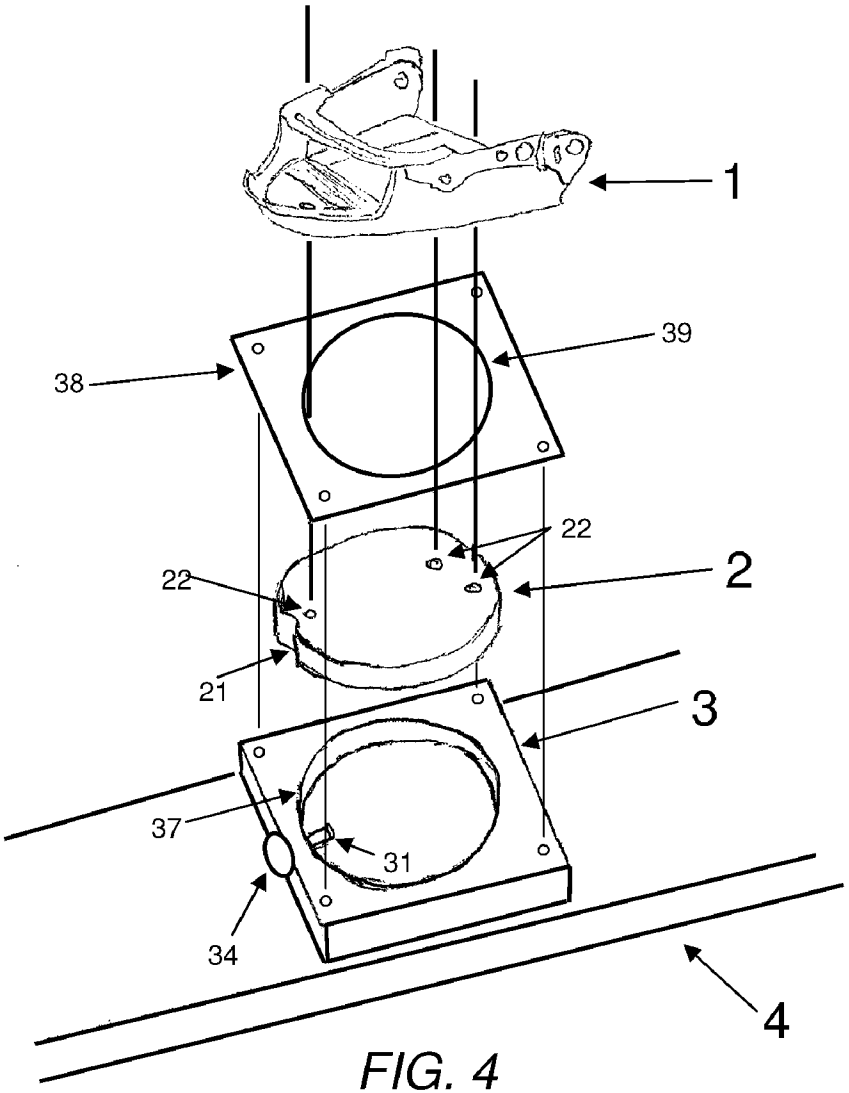
FIG. 4 shows a partially exploded view of another exemplary embodiment of a binding.

Alternatively, as shown in FIG. 4, the upper coupler 2 could be kept from substantially translating vertically by attaching a cover, such as escutcheon 38 to the lower coupler 3, so that the upper coupler is trapped between the cover and the lower coupler. The escutcheon 38 should have an opening 39 that is so sized, shaped, and positioned that the upper coupler 2 cannot fit through the opening. But the opening 39 should also be so sized, shaped, and positioned as not to prevent fixing the toepiece 1 to the upper coupler 2. In the illustrated embodiment, the escutcheon 38 has an aperture large enough to permit screws to pass through the toe piece 1 and into the screw holes 22 but small enough so that the upper coupler 2 cannot slip through the aperture. The escutcheon 38 is fixedly attached to the lower coupler 3 with enough clearance between escutcheon 38 and the toepiece 1 and upper coupler 2 to allow for rotation of the toepiece 1 and upper coupler 2 relative to the lower coupler 3 but substantially no vertical translation of the toepiece 1 and upper coupler 2 relative to the lower coupler 3. A benefit of covering the top of the system with an escutcheon 38 is that the internal mechanisms would be protected from snow and ice during skiing.

The toe piece can be attached to a post, or plate attached to a post, which passes through a sintered bushing on the escutcheon. This arrangement allows the upper coupler to rotate with the toe piece through an escutcheon that is relationally fixed relative to the ski, akin to the arrangement of a door handle.

Other possible methods of attaching the upper coupler 2 to the lower coupler 3 so as to allow for rotation of the upper coupler 2 relative to the lower coupler 3 but substantially no vertical translation of the upper coupler 2 relative to the lower coupler 3 include: a circular rail attached to the floor of the opening 37 that mates with a complementary circular track in the bottom side of the upper coupler 2; a groove or ridge in the vertical wall of the opening 37 that mates with a ridge or groove respectively in the horizontal side of the upper coupler 2; or so forming the horizontal wall of the opening 37 as to have a shoulder at the top that overhangs the upper coupler 2 and has the same effect as the escutcheon 38.

The upper coupler 2 is only allowed to rotate freely relative to the lower coupler 3 when a set threshold torque is exceeded. A wide variety of mechanisms that achieve this result may be used; a number of exemplary embodiments are shown in the figures.

In FIGS. 1, 2, 3*a*, and 4, the upper coupler 2 is shown as being substantially rotationally fixed by a horizontal pin 31 that is biased against the upper coupler 2 by a spring mechanism 33. The horizontal pin 31 substantially rotationally fixes the upper coupler 2 by mating with a concave vertical groove 21 in the side of the upper coupler 2. In the present embodiment, the profile of the groove is roughly Gaussian, i.e., a bell curve, but a wide variety of other shapes could be used as well. For example, a relatively steep curve could be used to increase the threshold torque required to trip the coupler, while a relatively shallow curve could be used to decrease the threshold torque.

When exposed to no torques, the system will be biased to settle with the pin 31 sitting in the deepest part of the groove 21, i.e. the upper coupler 2 will settle at a rotational orientation with the pin 31 at the trough of the bell curve 21. When the upper coupler 2 is exposed to a torque relative to the lower coupler 3, the upper coupler 2 will tend to turn, forcing the groove 21 to move relative to the pin 31 and forcing the pin 31 against the spring mechanism 33. A torque below a certain threshold torque will not be sufficient to substantially compress the spring mechanism 33, in which case the horizontal pin 31 will stay in the groove 21, and the upper coupler 2 will stay substantially rotationally fixed relative to the lower coupler 3. A torque above the threshold torque will push the horizontal pin 31 far enough into the receiving hole 32 by compressing the spring mechanism 33, that the horizontal pin 31 will escape the groove 21, leaving the upper coupler 2 free to rotate relative to the lower coupler 3. These two states are shown respectively in FIG. 3*a*, in which the horizontal pin 31 remains in the groove 21, and in FIG. 3*b*, in which the horizontal pin 31 has been ejected from the groove 21 and pushed into the receiving hole 32, leaving the upper coupler 2 free to rotate relative to the lower coupler 2.

Figure 3A:
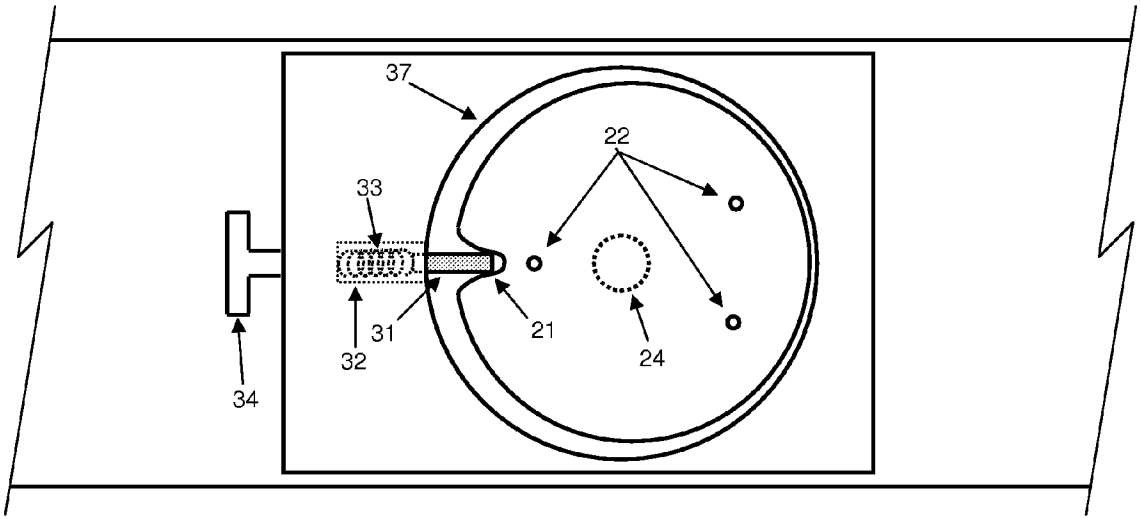
FIGS. 3*a* and 3*b* are overhead views of the same embodiment with the toepiece removed.
Figure 3B:
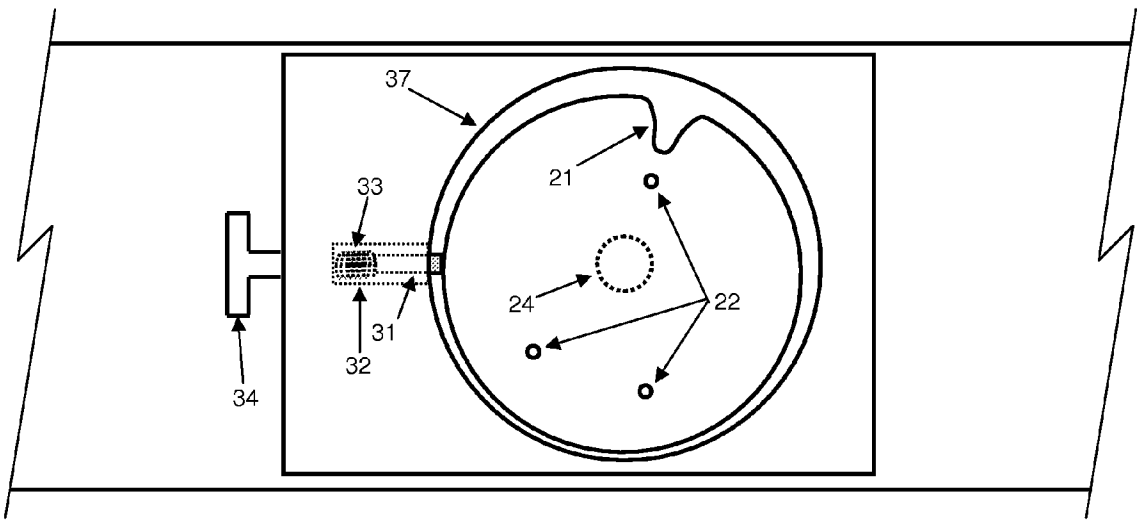

The amount of torque necessary to cause a transition from the substantially non-rotatable arrangement in FIG. 3*a* to the freely rotatable arrangement in FIG. 3*b* is defined by the shape of the groove 21 and the amount of force with which the horizontal pin 31 is biased against the upper coupler 2 by the spring mechanism 33. An adjustment device 34 sets this threshold torque by making adjustments to the spring mechanism 33. Any device capable of adjusting the force with which the pin 31 is biased against the upper coupler 2 will suffice. This adjustment device is the equivalent of a "DIN" setting on traditional releasable alpine bindings, defining the threshold torque between the skier and the ski at which the binding will transition into its freely rotating state.

Once in the freely rotating state shown in FIG. 3*b*, the upper coupler 2 will tend to return the system to its substantially rotationally fixed state, shown in FIG. 3*a*. This tendency is called a "return-to-center force" (RTCF). The RTCF is generated by the interaction of the biased pin 31*a* with the shape of the upper coupler 2*a*, best seen in FIG. 5. The shape of the upper coupler 2 in this embodiment is visible in FIG. 3 and is shown in detail in FIG. 5. The radius of the upper coupler 2*a*, i.e. the distance from the axis of rotation to the edge, varies as a function of azimuthal angle around the upper coupler 2*a*. The radius $r_1$, from the axis of rotation to the part of the edge nearest to the groove 21*a*, is smallest. The radius $r_2$ is larger, and the radius $r_3$, to the point on the edge farthest from the groove 21*a*, is the largest.

Figure 5:
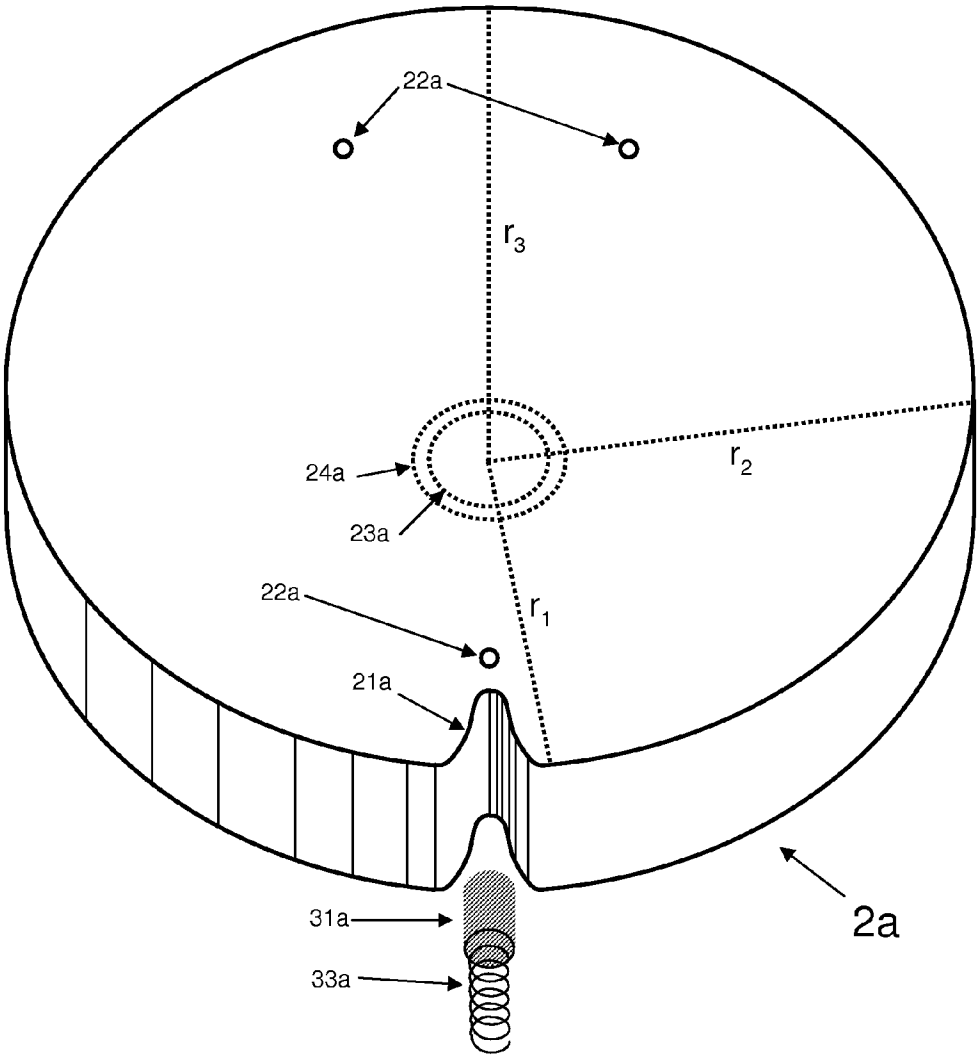
FIG. 5 shows an embodiment of a coupler with a horizontal pin.

Suppose the system has rotationally decoupled, and the upper coupler 2*a* has rotated roughly 180 degrees so that the pin 31*a* is held against the side of the upper coupler 2*a* near where the radius is shown as $r_3$ in FIG. 5. Because the radius is largest at $r_3$, the spring mechanism 33*a* will be at its most compressed. The force of the spring mechanism 33*a* will tend to turn the upper coupler 2*a* toward a rotational orientation with smaller radius like $r_2$ with the upper coupler 2*a* eventually returning to where the radius is smallest, returning the pin 31*a* to the groove 21*a*. This tendency is the RTCF. Thus, after the threshold torque has been exceeded (as when the skier falls and the ski strikes a surface) and the upper coupler 2*a* and lower coupler 3*a* rotationally decouple as in FIG. 3*b*, if the external torques are removed (as when the skier stops falling), the system will tend to return to the rotationally coupled position shown in FIG. 3*a*; the system will naturally "return to center." For example, once a skier's fall has completed, the skier can simply hold the decoupled ski off the ground and allow it to swing back to the center position. Alternatively, the skier can push the ski back into the center position. Moreover, while the skier is executing a maneuver that exerts torques near the threshold, the system, in beginning to "give" form the center position, may communicate to the skier that he or she is approaching the threshold; such feedback may help the skier keep control of the maneuver.

The RTCF can be achieved in this horizontal-pin embodiment by a wide variety of shapes of the upper coupler 2*a*. Ellipses, ovals, off-center circles and other elongated or eccentric curved shapes will suffice. Shapes with varying radius of curvature will suffice.

FIGS. 5, 6, 7, 8, 9, 10 and 11 show various embodiments of the interaction between the upper coupler 2 and the lower coupler 3.

FIG. 5 shows the horizontal pin embodiment described above.

Figure 6:
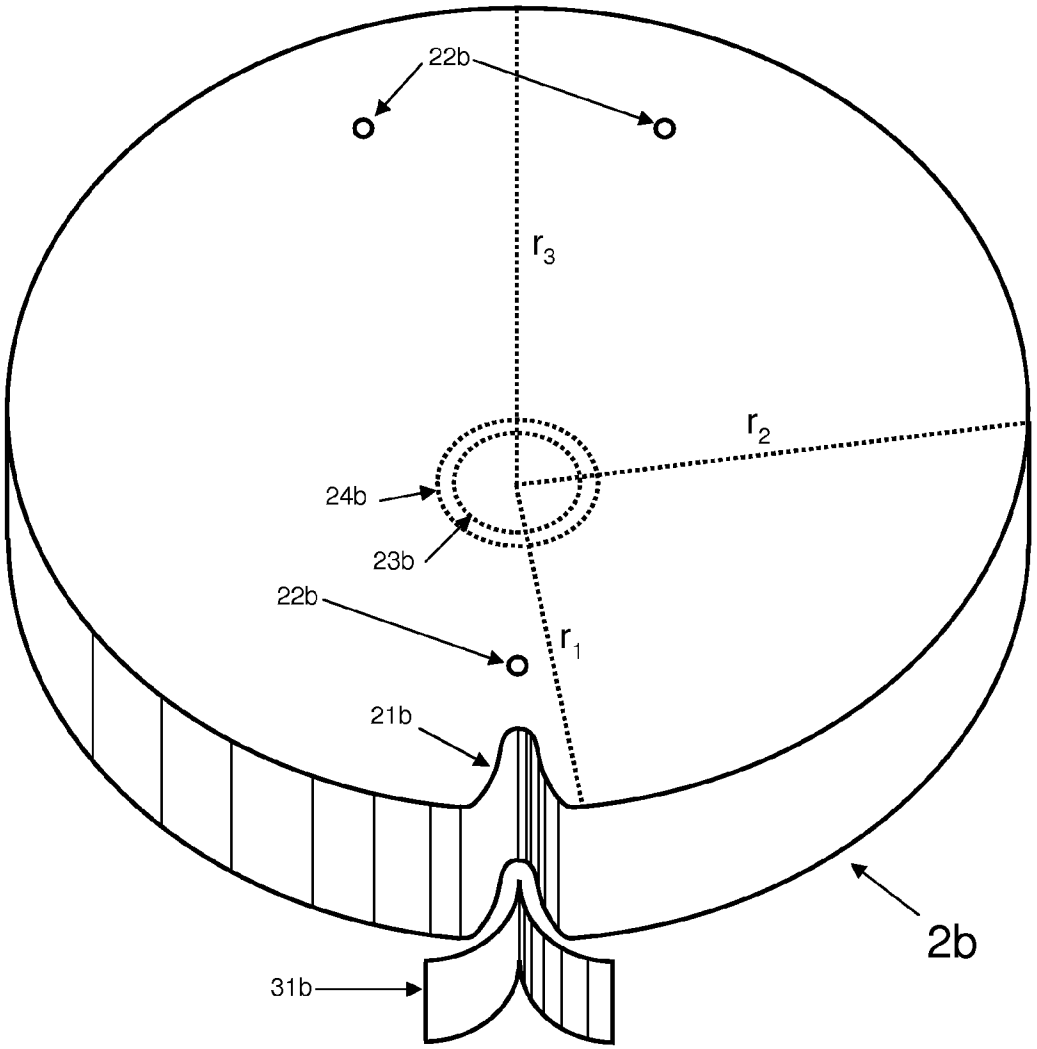
FIG. 6 shows an embodiment of a coupler with a wing-shaped spring.

FIG. 6 shows a similar embodiment, in which a wing-shaped piece of spring steel (the "wing-spring") 31*b* mates with the vertical groove 21*b*. The wing-spring 31*b*, like the pin 31*a* in FIG. 4, may be biased against the upper coupler 2*b*, by a mechanism capable of adjusting the force between the wing-spring 31*b* and the upper coupler 2*b*. The shape of the upper coupler 2*b* as shown is the same as shown in FIG. 5, but again, any of a wide variety of curved shapes will suffice.

Figure 7:
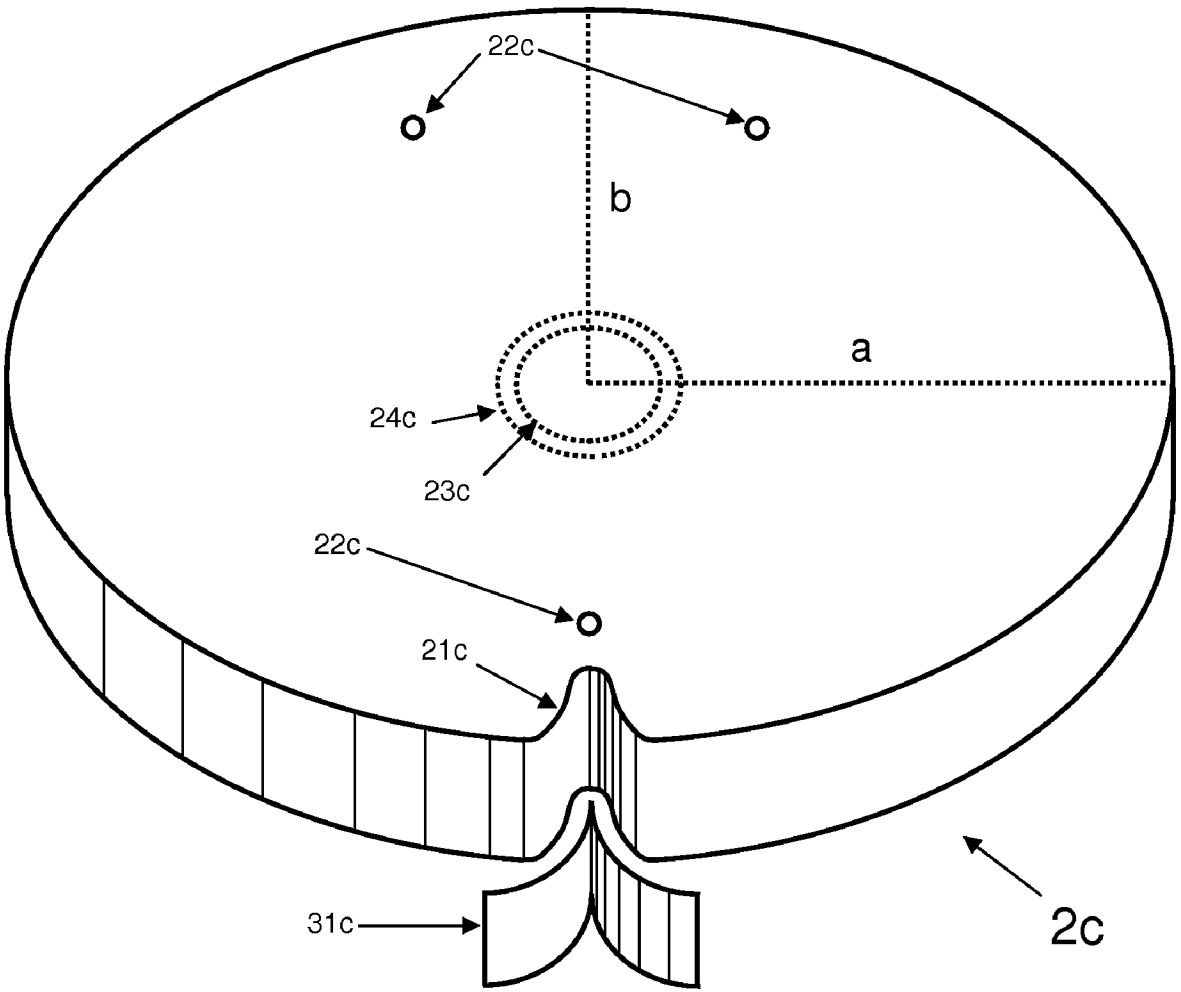
FIG. 7 shows an embodiment of an oblong coupler.

FIG. 7 shows a similar embodiment, again with a wing-spring 31*c* biased against an upper coupler 2*c*. As in the embodiment of FIG. 6, the wing-spring 31*c* would be adjustably biased against the upper coupler 2*c*. In this embodiment, the shape of the upper coupler 2*c* is elongated, with a semi-major axis a which is longer than a different semi-minor axis, b. The upper coupler 2*c* is shown as elliptical, but need not be.

Figure 8:
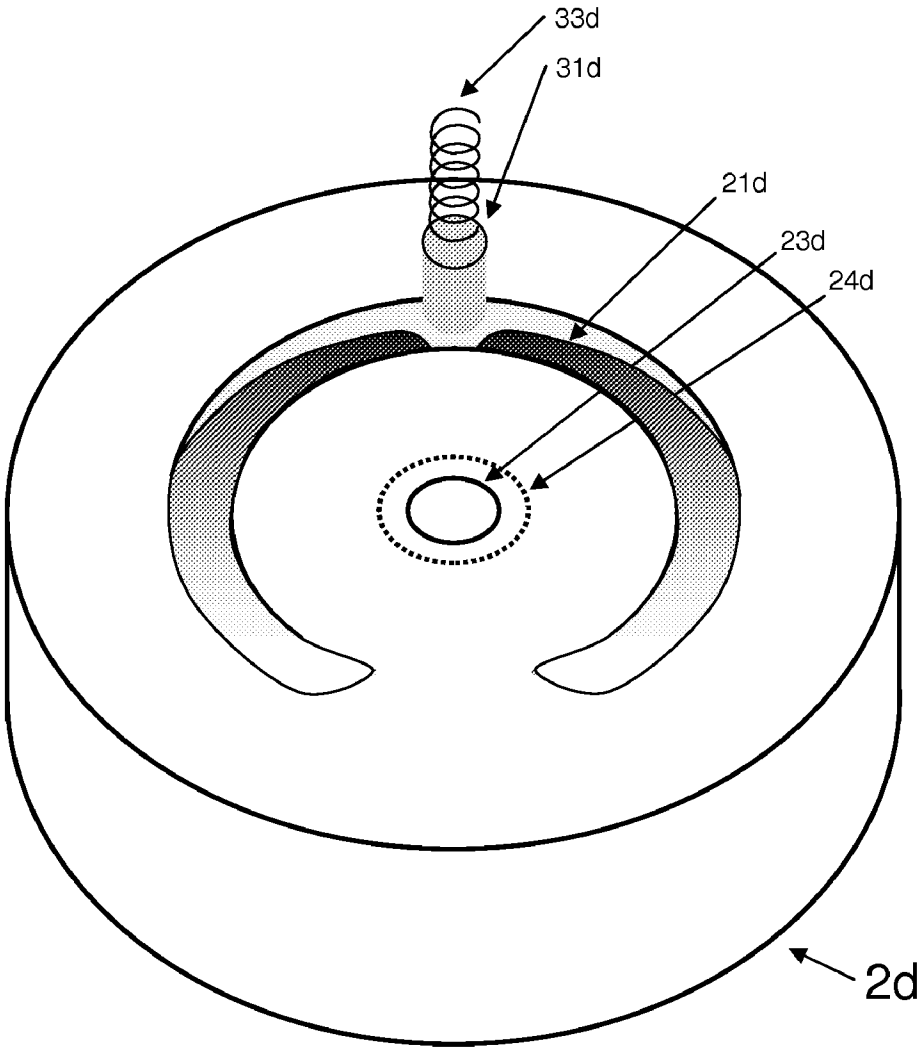
FIG. 8 shows an embodiment of a coupler with a vertical pin and corresponding groove of varying depth.

FIG. 8 shows an embodiment in which a vertical pin 31*d* is adjustably biased by a spring mechanism 33*d* against the upper coupler 2*d*. FIG. 7 shows the upper coupler inverted for clarity, so that a blind bulb-receiving hole 24*d* is visible. The vertical pin 31*d* sits in a trench 21*d* of varying depth. The trench 21*d* has a deepest point where the vertical pin 31*d* sits when the system is in its rotationally coupled state. The rest of the trench 21*d* slopes toward this deepest point. Similar to the embodiment in FIG. 4, a torque below the threshold torque will fail to compress the spring mechanism 33*d* and the upper coupler 2*d* will remain substantially rotationally fixed. A torque above the threshold torque will compress the spring mechanism 33*d*, and the upper coupler 2*d* will be allowed to rotate with the vertical pin 31*d* traveling in the shallowly sloped part of the trench. The slope of the trench 21*d* creates a RTCF analogous to the RTCF created by the varying radius of the upper coupler 2*a* in FIG. 4.

Figure 9:
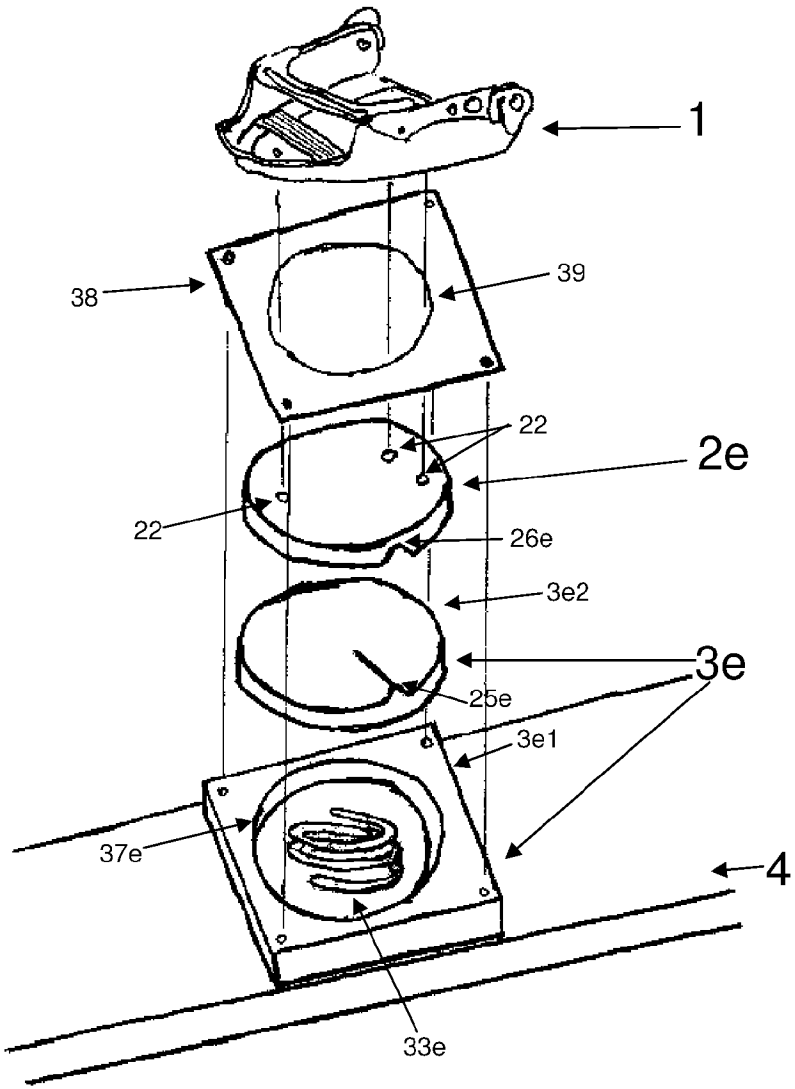
FIG. 9 shows a partially exploded view of a binding embodiment with corresponding ridge and groove.
Figure 10:
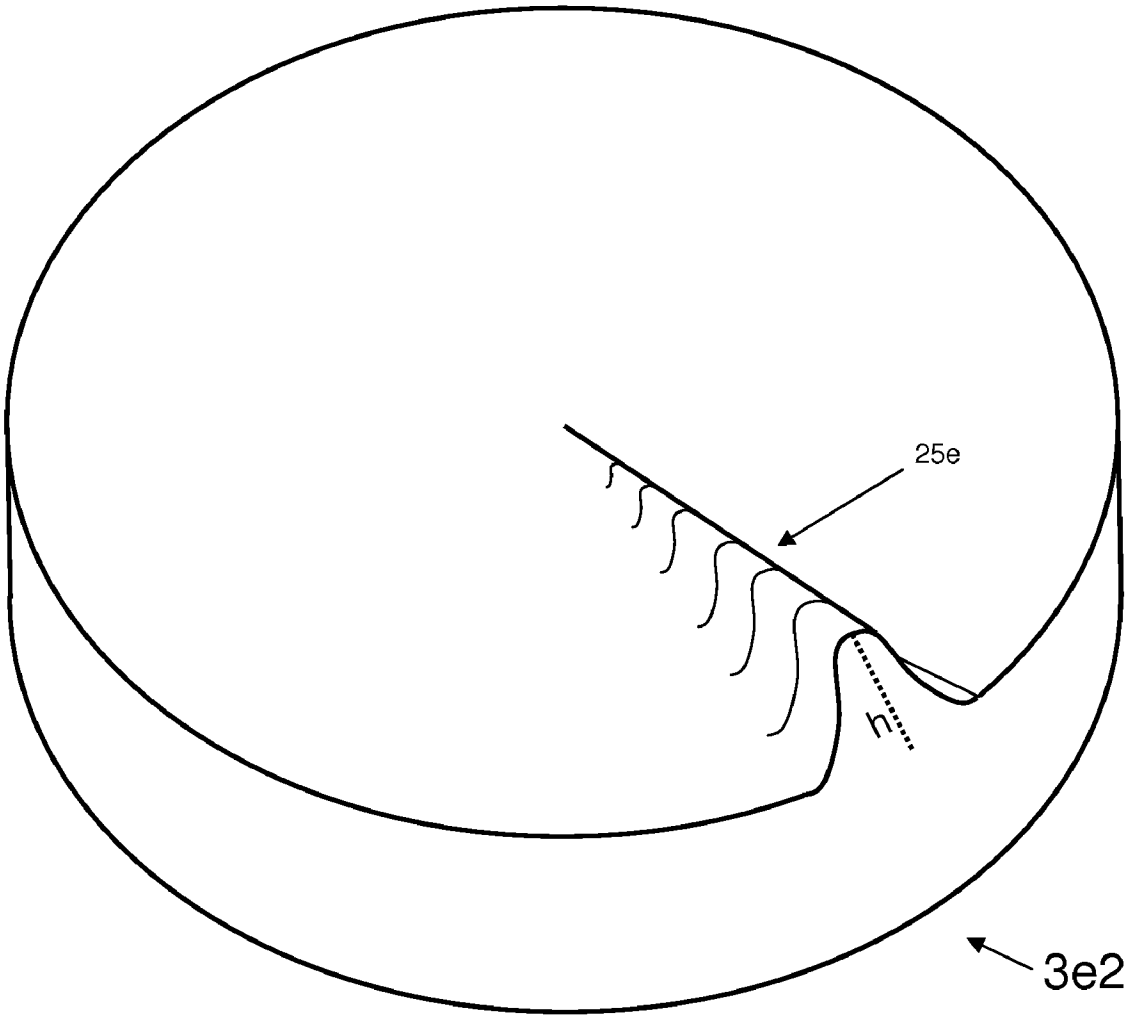
FIG. 10 shows a coupler having a ridge.

FIGS. 9, 10 and 11 show another embodiment of a decoupling mechanism by which the upper coupler 2*e* and lower coupler 3*e* interact. Instead of relying on a pin or wing-spring, in this embodiment, the upper coupler 2*e* and the lower coupler 3*e* have complementary engaging faces. Any pair of complementary engaging faces that achieve the desired effect of staying rotationally coupled below a set threshold torque and rotating above that threshold torque would suffice. The upper coupler 2*e* and lower coupler 3*e* should somehow be held sufficiently close to one another that the complementary features may interact with one another. For example, one or both couplers could be biased toward one another by a spring mechanism.

In the embodiment shown in FIGS. 9, 10, 11*a*, and 11*b*, the engaging faces include a radially extending ridge 25*e* in the top face of the lower coupler 3*e*, and a complementary radial trench 26*e* in the bottom face of the upper coupler 2*e*. The ridge has a height h at the edge of the lower coupler 3*e*2, as indicated in FIG. 10. The lower coupler includes at least two main parts, the lower engaging plate 3*e*2, and the housing 3*e*1. The housing 3*e*1 is fixedly attached to a ski 4 and can neither rotate nor translate relative to the ski. The housing includes a spring mechanism 33*e* that adjustably biases the lower engaging plate 3*e*2 upwards against the upper coupler 2*e*. The lower engaging plate 3*e*2 is rotationally fixed relative to the housing 3*e*1 so that the entire lower coupler 3*e* is rotationally fixed relative to the ski 4. The lower engaging plate 3*e*2 is allowed a small amount of vertical translation, but only by compressing or decompressing the spring mechanism 33*e*, and thus the lower engaging plate 3*e*2 is substantially translationally fixed. The upper coupler 2*e* cannot translate and is held substantially translationally fixed by the lower engaging plate 3*e*2 from below and the escutcheon 38 from above. The upper coupler 2*e* is, however, potentially capable of rotation relative to the lower engaging plate 3*e*2, and thus relative to the lower coupler 3*e* as a whole.

Figures 11A, 11B:
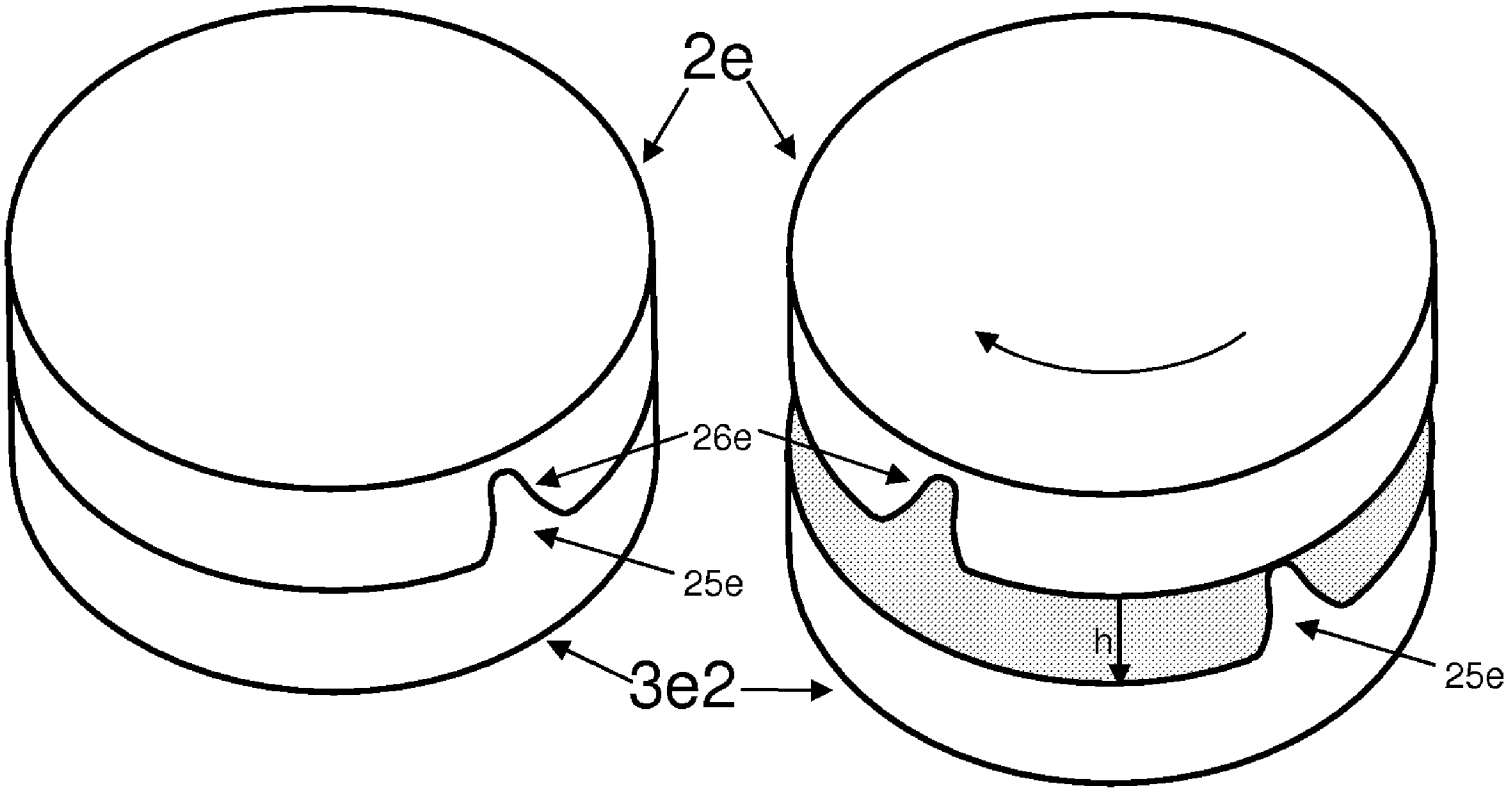
FIGS. 11*a* and 11*b* show the rotational decoupling of the couplers in the embodiment of FIG. 9.

When the set threshold torque is not exceeded, the upper coupler 2*e* and lower engaging plate 3*e*2 stay with their complementary faces mated, as shown in FIG. 11*a*. The spring mechanism 33*e* is in a relatively uncompressed state, because the lower engaging plate 3*e*2 is in its highest position. Torques below the set threshold torque will be insufficient to dislodge the ridge 25*e* from the mating trench 26*e*. When the set threshold torque is exceeded, however, the upper coupler 2*e* will rotate, forcing the ridge 25*e* out of the trench 26*e*. This will force the lower engaging plate 3*e*2 to translate downward, compressing the spring 33*e*. Only if the torque is sufficient to compress the spring mechanism 33*e* by a distance equal to the height of the ridge, h, will the upper coupler be allowed to rotate freely. The spring mechanism 33*e* is adjustable so as to set the threshold torque.

In addition to defining the trench 26*e*, the underside of the upper coupler 2*e* may be contoured. The contour could be shaped such that, when the upper coupler 2*e* and the lower coupler 3*e* have rotationally disengaged, the contour interacts with the ridge 25*e* to create a RTCF, as in the previously described embodiments.

The ridge and trench may be swapped, so that the upper coupler includes a ridge, and the lower coupler defines a trench. The lower engaging plate 3*e*2 and the upper coupler need not have the ridge 25*e* and mating trench 26*e*; other shapes can achieve the same result. For example, a post that mates with a groove of varying depth, similar to vertical pin embodiment in FIG. 8 would suffice. Any two mating surface contours that, when one turns relative to the other, forces at least some translation perpendicular to the plane of rotation, would suffice.

Figure 12:
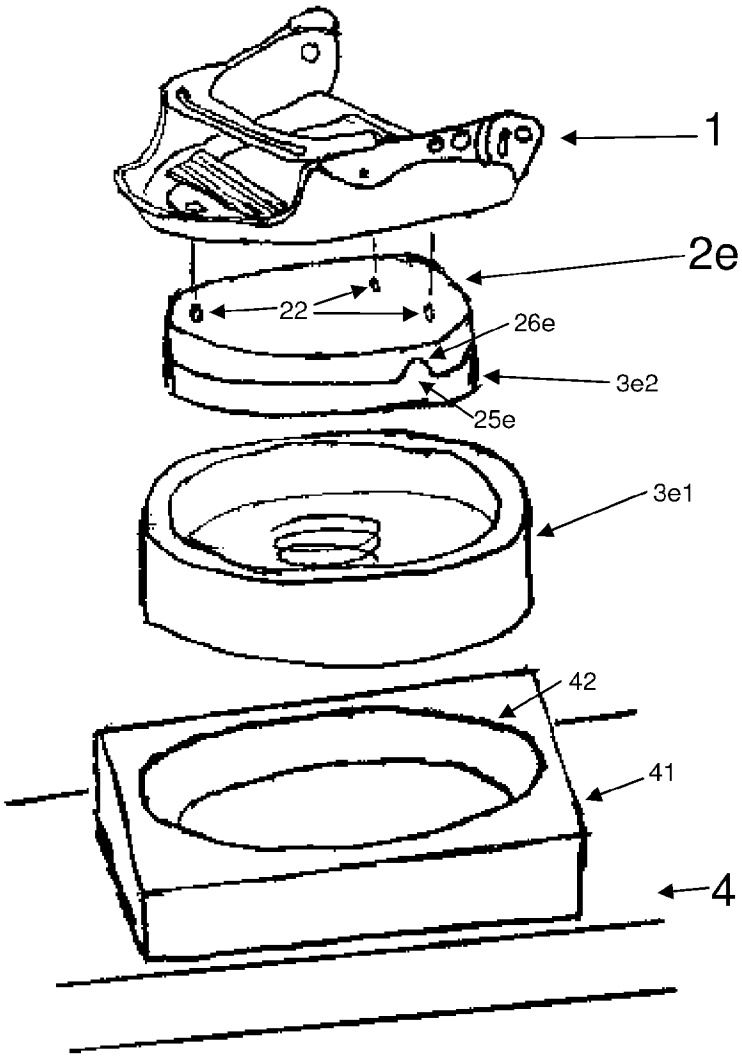
FIG. 12 shows a partially exploded view of another exemplary embodiment of a binding in which the couplers are housed in a riser.

FIG. 1 shows that the lower coupler 3 is fixedly attached to a ski 4. Any method of translationally and rotationally fixing the lower coupler to a ski 4 could be used. Many ski bindings are screwed directly into a ski, which would suffice to attach the lower coupler 3 to a ski 4. Other ski bindings are attached to skis with complementary track and rail systems, which would also suffice. Sometimes ski bindings are fixed to an intermediary plate or a riser, which plate or riser is itself fixed to a ski; such an arrangement would suffice, and is indicated in FIG. 12. FIG. 12 shows an embodiment similar to that of FIG. 9, except that in the case of FIG. 12 the housing 3*e*1 is only slightly larger than the upper coupler 2 and the lower engaging plate 3*e*2. Thus, when assembled, the upper coupler 2*e* and the entire lower coupler 3*e* including the housing 3*e*1 and the lower engaging plate 3*e*2, can fit into a cylindrical cutout 42 in a riser 41 so that the housing 3*e*1 is fixedly attached to riser 41. The riser 41 in turn is fixed to a ski 4. Any method by which the lower coupler is fixedly attached to a ski, with or without intervening parts such as risers or plates, will suffice.

Figure 12A:
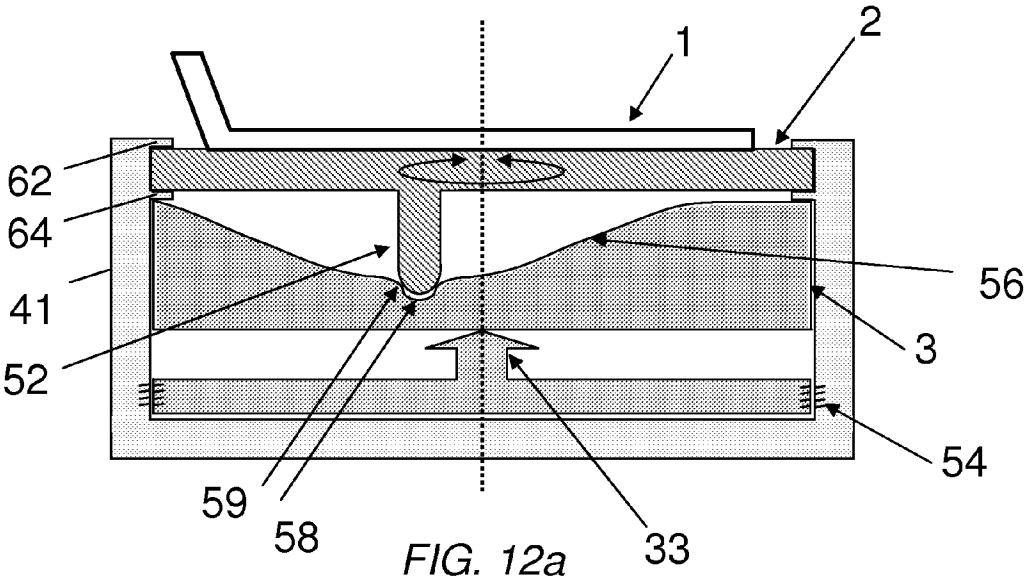
FIGS. 12*a* and 12*b* show cross-sections of another exemplary embodiment of a binding in which the couplers are housed in a riser.
Figure 12B:
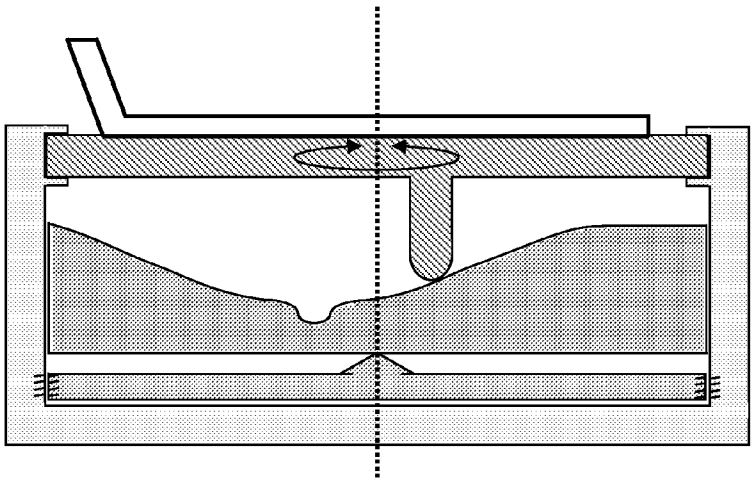

FIGS. 12*a* and 12*b* show another embodiment of a bonding in which the couplers are housed in a riser. Binding 1 is fixed to upper coupler 2, which is mounted in riser 41 at a fixed height, as by brackets 62 and 64, but free to rotate. Peg 52 protrudes from the bottom face of upper coupler 2. Lower coupler 3 is also inside the riser and can float up an down but is rotationally fixed, as by vertically-oriented rails (not shown) engaging it with the inner wall of the riser. The upper surface of lower coupler 3 has a contour 56 that forms a dish shape, preferably with a central depression 58 defined by ridge 59. The lowest point of the upper surface (typically the center of depression 58) is displaced from the upper coupler's center of rotation and is positioned so that peg 52 lies at the lowest point in the resting orientation (FIG. 12*a*). Biaser 33 (typically a spring) urges the lower coupler up against the peg. The biaser's position may be adjustable, as by screw threads 54, to control the force applied to the coupler (and thereby the torque threshold). Torque on the binding is transmitted to the upper coupler and peg 35, causing peg 35 to press against ridge 58. When the torque exceeds a threshold (determined in part by the biaser's position), the peg will ride up and out of the ridge (FIG. 12*b*), pushing the lower coupler down as it turns in a circular path around the upper coupler's axis of rotation A-A in contact with the upper surface of the lower coupler. The biaser and sloping contour provide RTCF.

The rotational decoupler is typically positioned immediately below the ball of the user's foot, thereby promoting balance. Moreover, it is typically positioned at or near the highest point of a ski's camber and thereby helps the user reverse the camber as his or her weight is applied to the ski.

Decouplers employing vertical relative movement between the couplers can easily be reset to rest position (i.e., returned to center) after a decoupling event by holding the ski off the ground and allowing (or turning) the ski back to the proper orientation. Gravity helps keep the couplers apart during repositioning and so facilitates recoupling by helping to prevent interference between the contours of the decouplers. The ski is held in mid-air in such a way that the upper coupler is located above the lower coupler, so that gravity tends to displace the couplers vertically from one another. After allowing the ski to return to center, the skier may resume skiing.

2. Tracked Alpine Touring Binding

Figure 13A:
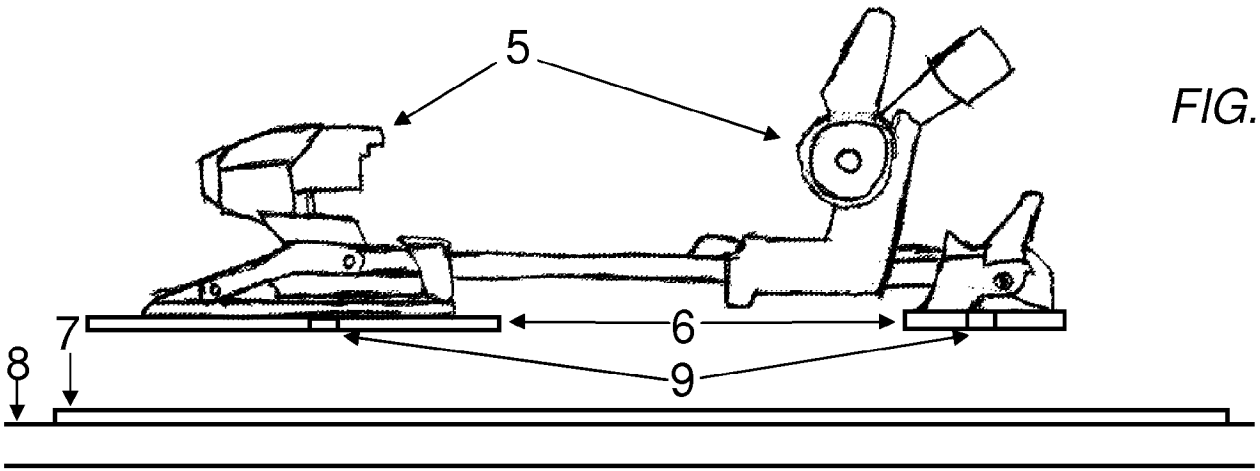
FIGS. 13*a* and 13*b* show an embodiment of a railed alpine touring binding detached from a ski (FIG. 13*a*) and attached to a ski (FIG. 13*b*).
Figure 13B:
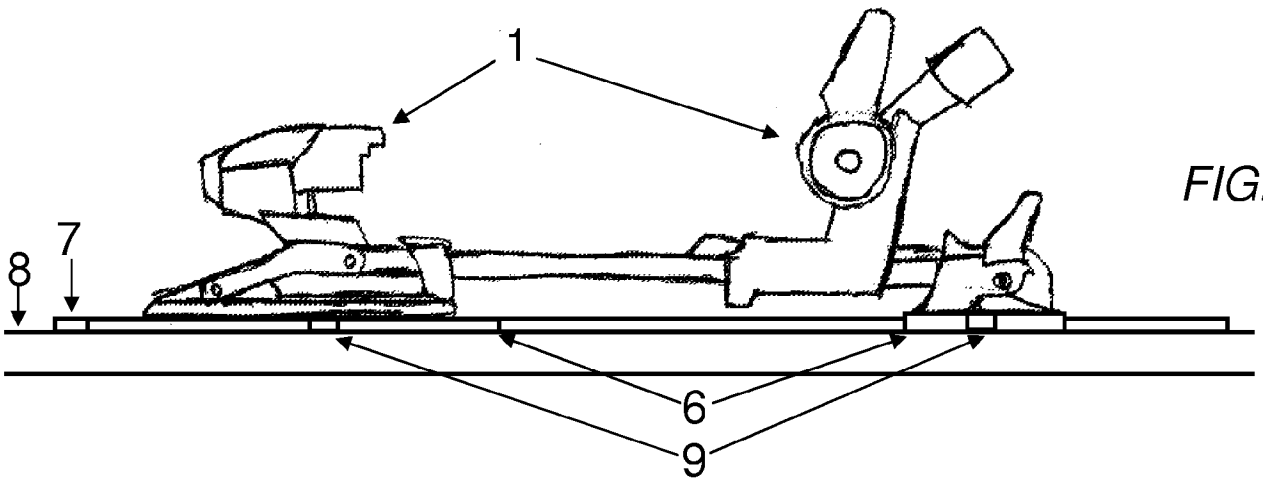

FIG. 13*a* shows a alpine touring binding 5 with a rail 6 separated from a ski 8 with a track 7; FIG. 13*b* shows the same alpine touring binding 5 attached to the ski 8.

The alpine touring binding 5 is a standard alpine touring binding that receives a skier's alpine touring boot but further includes the rail 6. Instead of being fixedly attached to the ski 8 with screws or adhesives or some other standard method, the alpine touring binding 5 is attached with a mating rail 6 and track 7 system.

Figure 14A:
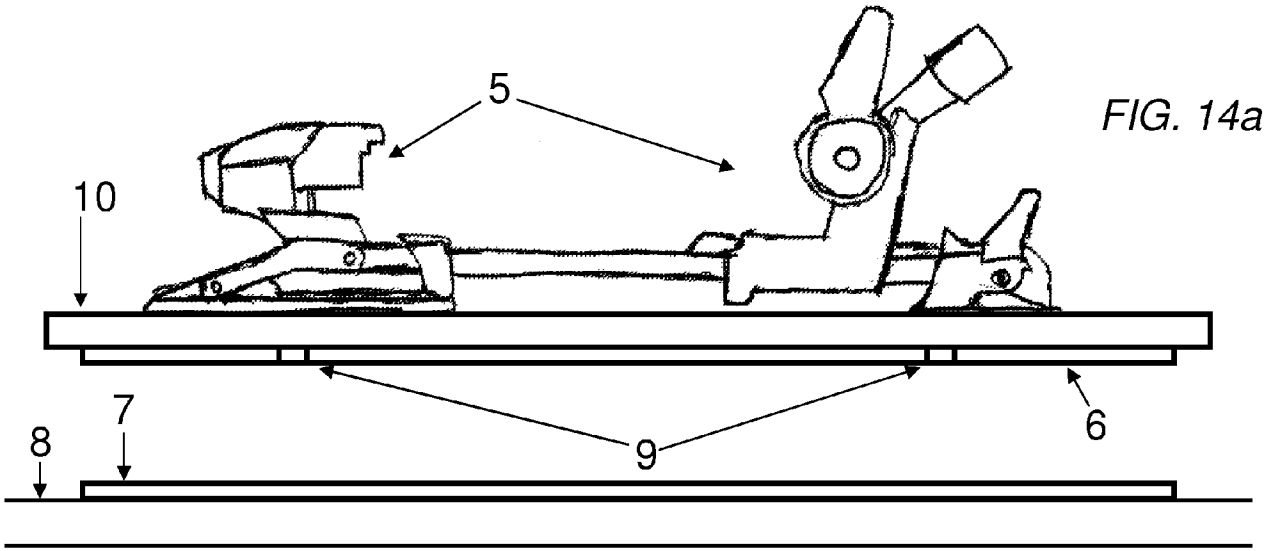
FIGS. 14*a* and 14*b* show an alpine touring binding on a railed plate detached from a ski (FIG. 14*a*) and attached to a ski (FIG. 14*b*).
Figure 14B:
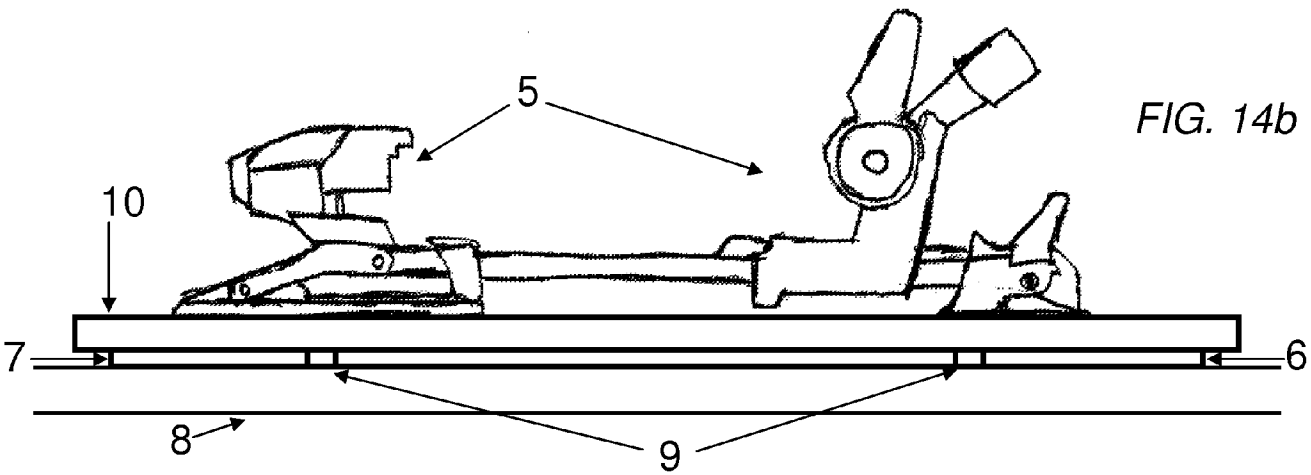

The rail 6 may either be integrally formed with the alpine touring binding 5, or fixedly attached to the alpine touring binding 5, or as shown in FIGS. 14*a* and 14*b*, the rail 6 could be attached to the alpine touring binding 5 by way of an intervening piece, such as a plate 10. Any arrangement that fixes the rail 6 relative to the binding 5 will suffice.

Figure 15C:
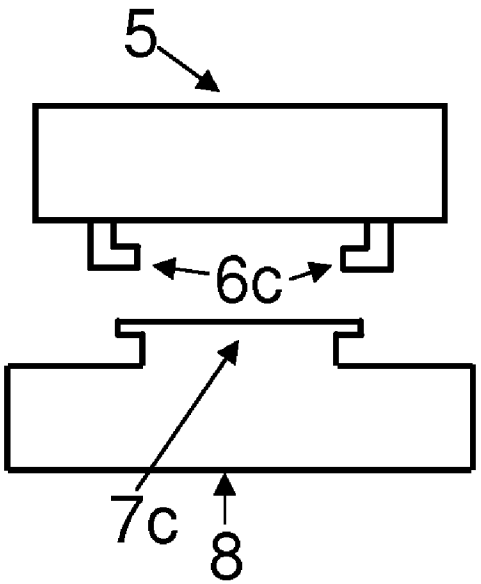
FIGS. 15*a*, 15*b*, and 15*c* show some examples of mating rails and tracks.
Figure 15B:
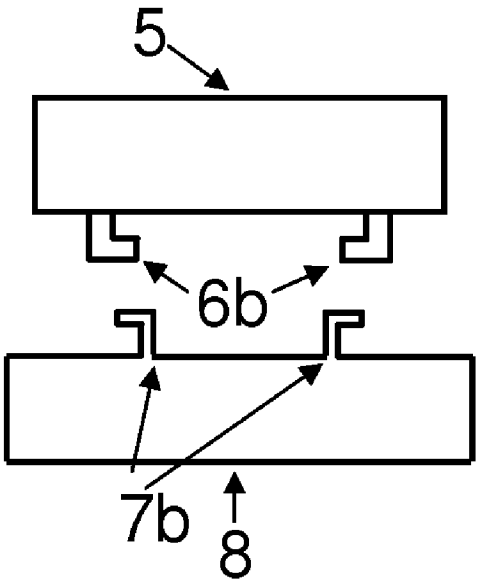
Figure 15A:
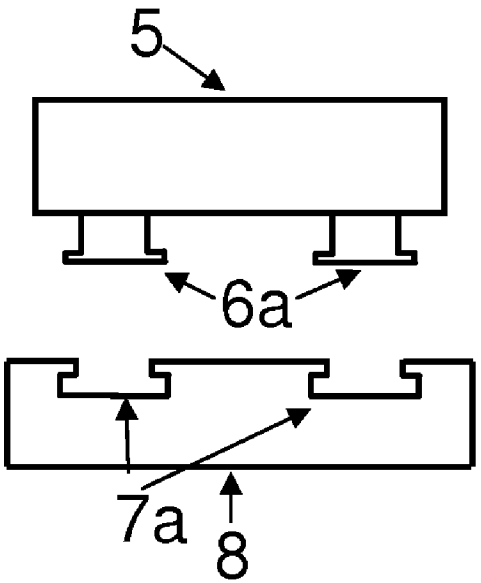

The rail 6 is shaped so as to mate with a track 7. FIGS. 15*a*, 15*b*, and 15*c* show cross-sections of several possible embodiments of mating rails 6*a*, 6*b*, 6*c* and tracks 7*a*, 7*b*, 7*c*. In every case, the rail 6 and the track 7 mate so as to allow the rail 6 to slide along the track 7 in the same direction as the long axis of the ski 8. Any cross-sectional shapes for the rail 6 and track 7 will suffice as long as the rail 6 and track 7 are slidably displaceable relative to each other. The trails and tracks may be swapped; i.e., the ski may include features 6*a*, 6*b*, or 6*c*, while the alpine touring binding may include features 7*a*, 7*b*, or 7*c*.

When in use for skiing, the rail 6 and the track 7 should be fixed so that the binding 5 does not slide along the length of the ski 8. FIGS. 13*a*, 13*b*, 14*a*, and 14*b* show a clamp 9 which can fix the rail 6 with respect to the track 7. FIGS. 13*a*, 13*b*, 14*a*, and 14*b* show the clamp 9 attached to the rail 6, but any mechanism by which the clamp 9 can fix the rail 6 with respect to the track 7 will suffice, whether permanently attached to the rail or not.

The track 7 must be fixed with respect to the ski 8. The track 7 may be integrally formed with, or fixedly attached to the ski 8. The track 7 may be generally concave as in track 7*a*, or might protrude from the top surface of the ski 8 as in tracks 7*b* and 7*c*. Any track that mates with the rail 6 and is fixedly attached to the ski 8 will suffice.

Fore and/or aft stops may be provided in the ski to limit the range of adjustability. The stops may themselves be variably positioned.

3. Method of Interchanging Bindings

FIGS. 16*a*, 16*b*, 16*c*, and 17 show three types of bindings 11*a*, 11*b*, 11*c* which, because they have rails 12 with identical cross-sections, are interchangeable on a ski 14 with a track 13 that mates with the rail 12.

Figure 16A:
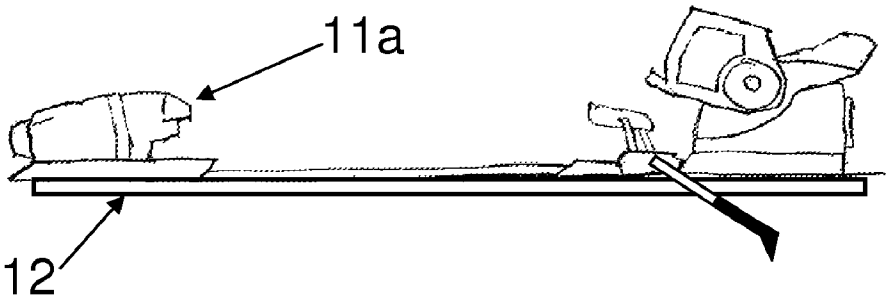
FIGS. 16*a*, 16*b*, and 16*c* depict exemplary embodiments of alpine, alpine touring, and telemark bindings, respectively, each affixed to rails having cross-sections identical among the different bindings.
Figure 16B:
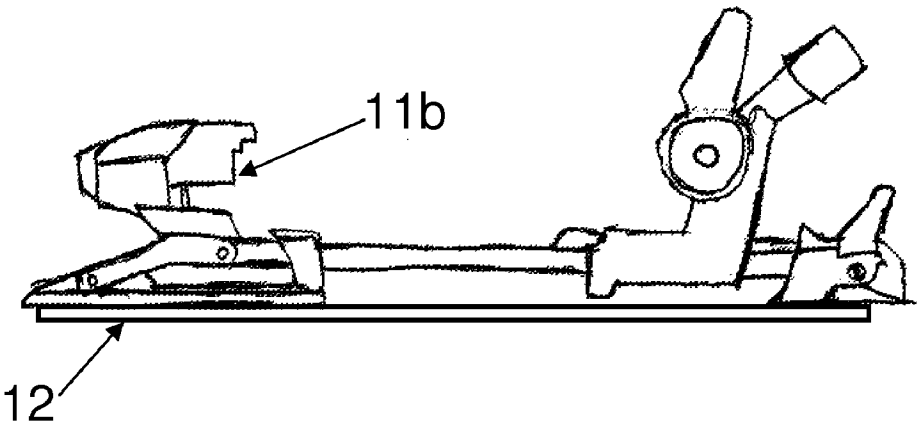
Figure 16C:
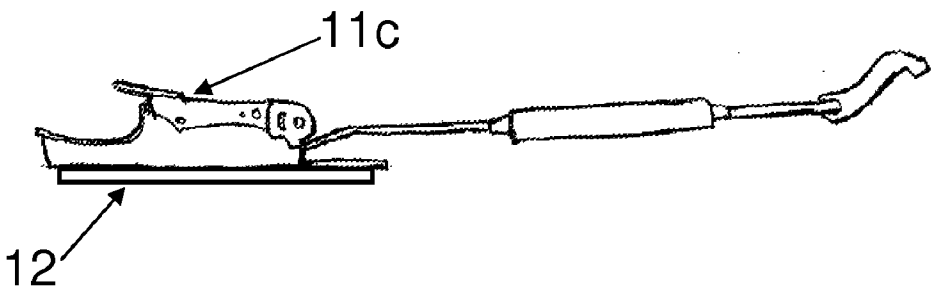

FIGS. 16*a*, 16*b*, and 16*c* shows an alpine binding 11*a*, an alpine touring binding 11*b*, and a telemark binding 11*c*, respectively. All three bindings are shown with a track 12. The different bindings can be used for different types of skiing. The various bindings may be interchanged on a single ski, thus allowing the skier to perform different types of skiing, without having to obtain or carry a different pair of skis for each type.

Figure 17:
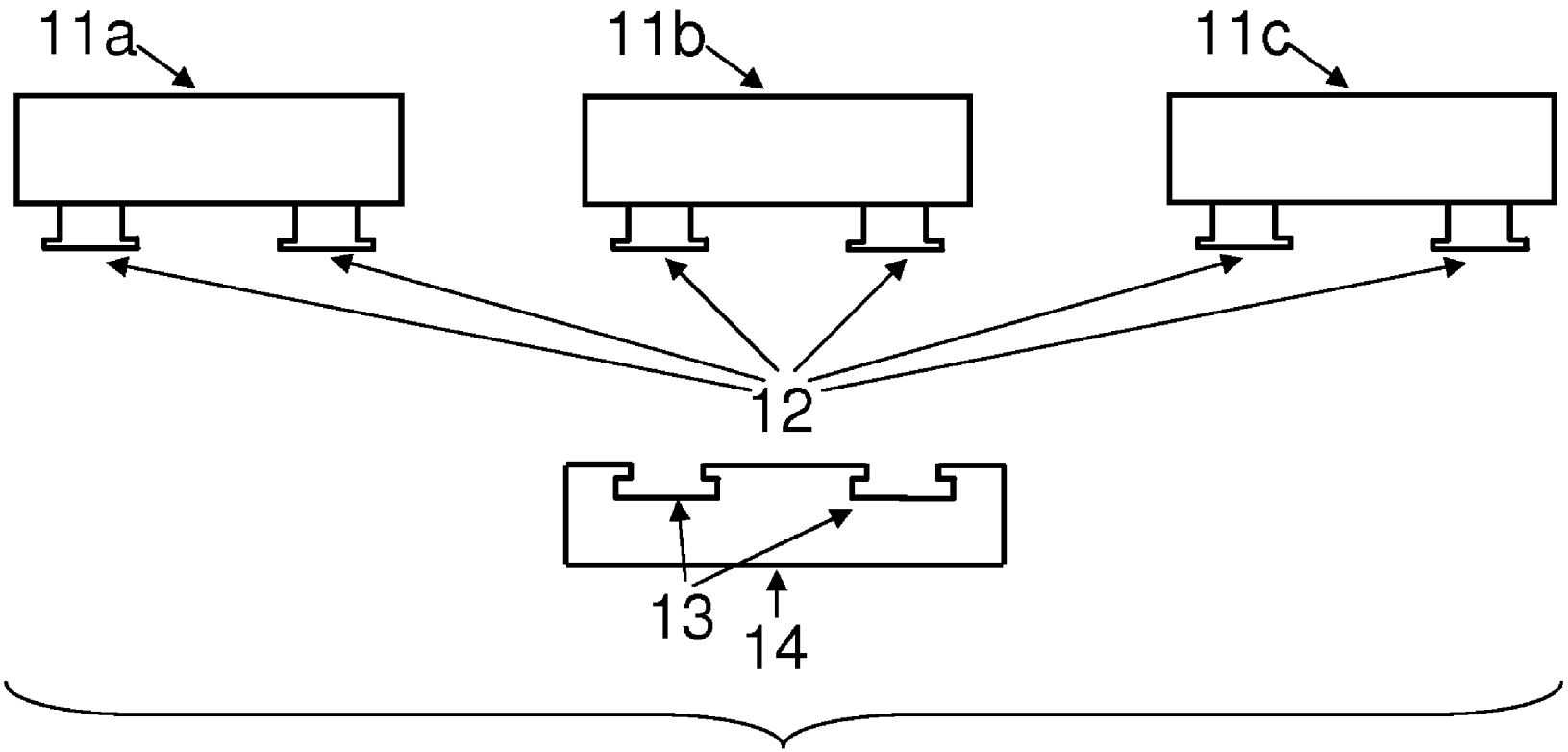
FIG. 17 schematically depicts the interchangeability of the three bindings of FIGS. 16*a*, 16*b*, and 16*c* on a single ski.

FIG. 17 shows a cross-section of a ski 14 with a track 13 and a schematic cross-section of each of the three types of bindings, alpine 11*a*, alpine touring 11*b*, and telemark 11*c*. Any type of mating track-and-rail system would suffice to be used in this method, but one in particular is shown, in which the track 13 defines a shaped groove in the ski 14, while the rail 12 protrudes downward from the bottom of the binding.

Many bindings, especially alpine and alpine touring bindings, have a D.I.N. setting. This setting determines how much force or torque can be applied to a skier's boot relative to the binding without the binding releasing the boot. Each D.I.N. setting corresponds to a certain threshold force or torque. When the threshold force or torque is exceeded, as when the skier falls for example, the binding releases the boot. Often when a binding is removed from or attached to a ski, the D.I.N. setting is lost, requiring a professional to readjust the binding. The method includes removing or attaching a ski binding, which binding has a D.I.N. setting, without altering that binding's D.I.N. setting.

4. Non-Vector Mounts

Figure 18:
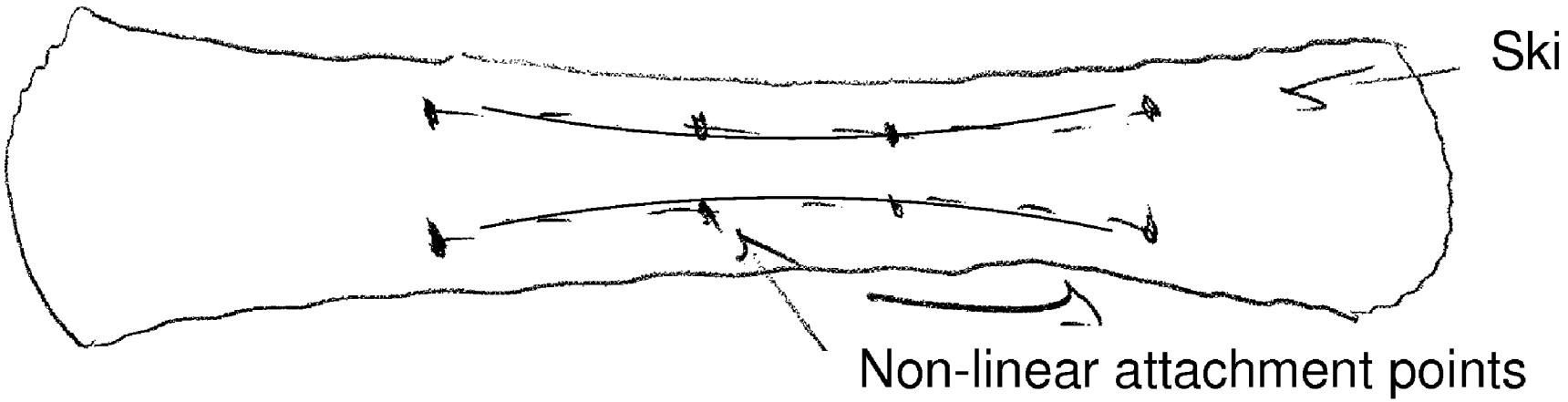
FIG. 18 schematically depicts a binding held to a ski with non-vector mounts.

Bindings and other parts may be affixed to skis, water skis, and/or snowboards using so-called "non-vector mounts," meaning that the points of attachment are nonlinear, as shown in FIG. 18. A binding may be attached, for example, with left- and right-hand rows of attachment points. The points of attachment may define arcs following circles that are concentric to but larger than circles that the arcs of the corresponding side of the ski follows. The points of attachment may define an arc having the same or similar radius of curvature as the corresponding side of the ski. The left- and right-hand rows of attachment points may form arcs that are symmetric to one another relative to a median axis (i.e., arcing in directions opposite to one another), or that are asymmetric, such as arcing in the same direction as one another. The points of attachment need not define arcs that "follow" the edges of the ski. The attachment points may be short stretches of rail and track. The attachment points may define semicircles or halves of other curves, such as ellipses or ovals. The attachment point arcs may together define an hourglass shape. Risers and plates can similarly be attached to skis with non-vector mounts.

The non-vector mounts can help distribute forces in the ski in a more regular or predictable way than for linear mounts. Moreover, if a toepiece is mounted on a non-vector mount such that the toepiece overhangs the mount, the user can direct forces to particular points on the ski by leaning appropriately or otherwise applying torque to the mount.

The non-vector mount can thereby facilitate smaller maneuvers with higher accuracy compared to linear mounts. For example, concentrated and directed torques applied in this way exert leverage on the ski to permit faster turns and achieve greater rebound from the ski. With a non-vector mount instead of a linear mount, a large stiff ski could be bent more, and more easily, giving it maneuverability characteristics of a smaller, lighter ski (or riding device). And because additional bend would momentarily shorten the radius of the ski against the snow it could arc in a shorter radius through part of the turn, which provides an advantage in slalom skiing. In some embodiments, a non-vector mount may be a cylinder, frustocone, prism, prismatoid, parallelepiped, cuboid, or cube. The non-vector mount may have a cross-section in a horizontal plane that is circular, oval, polygonal, convex, concave, or other shapes that permit the user to direct forces with precision.

5. Railed Telemark Ski Bindings

The various bindings thus disclosed may be provided with rails and used on tracked skis.

Figure 19A:
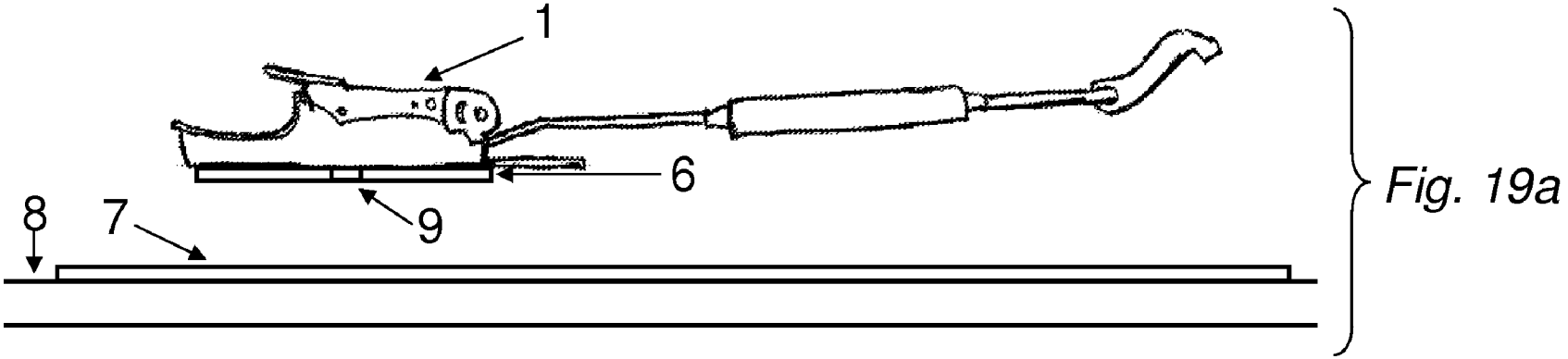
FIGS. 19*a* and 19*b* depict an exemplary embodiment of a railed telemark binding shown separate from and attached to a tracked ski, respectively.
Figure 19B:
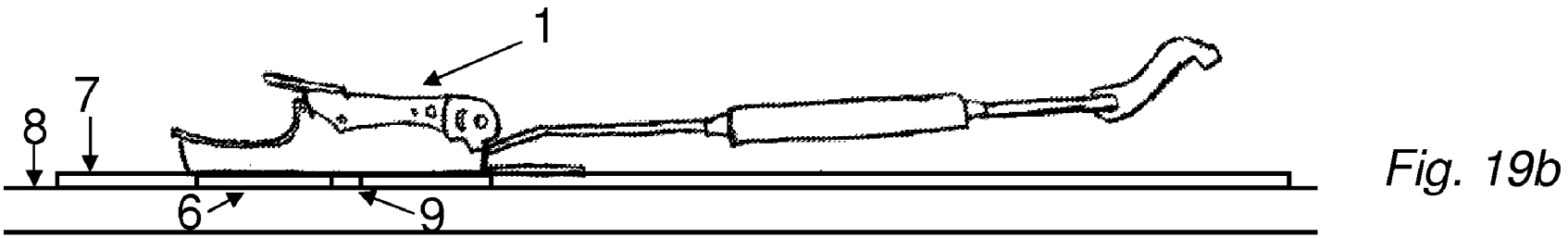

FIG. 19*a* shows a telemark binding 1 with an attached rail 6. The railed telemark binding is detached from a ski 8 with attached track 7. FIG. 19*b* shows the same telemark binding 1 attached to the ski 8 by way of a clamping interaction between the rail(s) and track(s).

The telemark binding 1 may be a standard telemark binding that receives a skier's telemark boot but that been modified to include rail 6. Instead of being fixedly attached to the ski 8 with screws or adhesives or some other standard method, the telemark binding 1 is attached with a mating rail 6 and track 7 system.

Figure 20A:
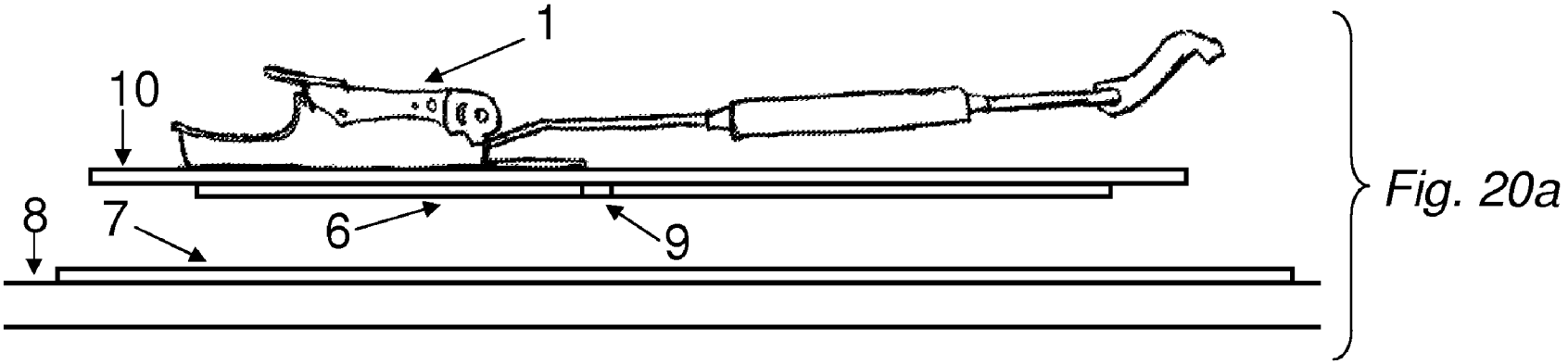
FIGS. 20*a* and 20*b* depict an exemplary embodiment of a telemark binding on a railed intermediary plate shown separate from and attached to a tracked ski, respectively.
Figure 20B:
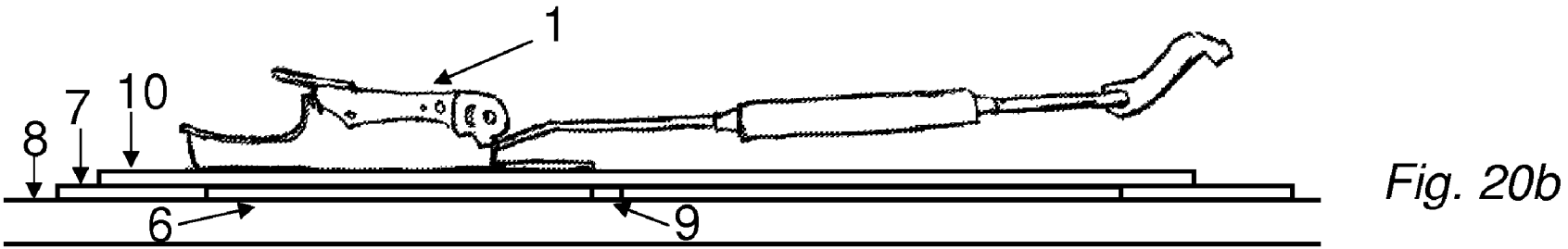

On the bottom of the telemark binding 1, there is a rail 6. The rail 6 may either be integrally formed with the telemark binding 1, or fixedly attached to the telemark binding 1, or as shown in FIGS. 20*a* and 20*b*, the rail 6 could be attached to the telemark binding 1 by way of an intervening piece, such as plate 10. Any arrangement that fixes the rail 6 relative to the binding 1 will suffice.

The rail 6 is shaped so as to mate with a track 7, such as described previously with respect to FIGS. 15*a*, 15*b*, and 15*c*.

When in use for skiing, the rail 6 and the track 7 should be fixed so that the binding 1 does not slide along the length of the ski 6. FIGS. 19*a*, 19*b*, 20*a*, and 20*b* show a clamp 9 which can fix the rail 6 with respect to the track 7. FIGS. 19*a*, 19*b*, 20*a*, and 20*b* show the clamp 9 attached to the rail 6, but any mechanism by which the clamp 9 can fix the rail 2 with respect to the track 7 will suffice, whether permanently attached to the rail or not.

The railed telemark bindings disclosed herein may be interchangeable with railed alpine and/or alpine touring bindings on a tracked ski.

5. Feedback

Vibrations in the ski and/or binding assembly may reflect particular motions the users carries out or stresses put on the ski and binding. These vibrations, if conveyed to the user, can provide status information on the ski and warnings to the user if the binding is approaching a threshold torque. The vibrations, if exposed to an air chamber, can create sound waves, which are easily detected, amplified, and conveyed to the user using known techniques (acoustic, piezoelectric, etc.). The can be conveyed as audio to the user's ear, or as light (such as one or more LEDs on the ski). A riser or a plate, normally used to attach a binding to a ski, may be hollowed to form an interior cavity to serve as such an air chamber; the cavity may be specially shaped for that purpose and also to minimize sources of noise such as secondary standing waves (which could also be eliminated digitally). Alternatively, the risers described herein that incorporate rotational decouplers may also provide an air chamber, such as the nominally bell-shaped space between the upper and lower decouplers in the embodiment shown in FIGS. 12*a* and 12*b*. A single point of contact can be provided between the upper coupler and lower coupler to serve as a transmission conduit for vibrations.

EXAMPLE

Figure 21:
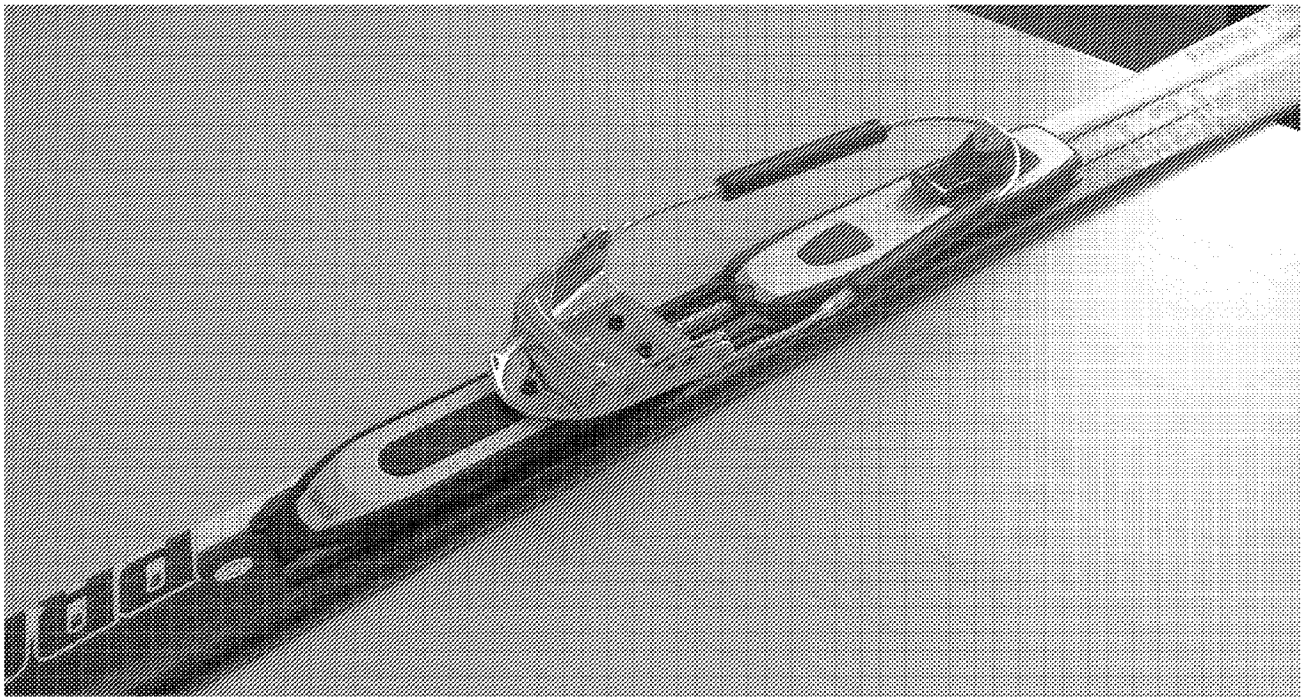
FIGS. 21 and 22 show perspective and side elevation views, respectively, of a prototype according to the embodiment of FIGS. 20*a* and 20*b*.
Figure 22:
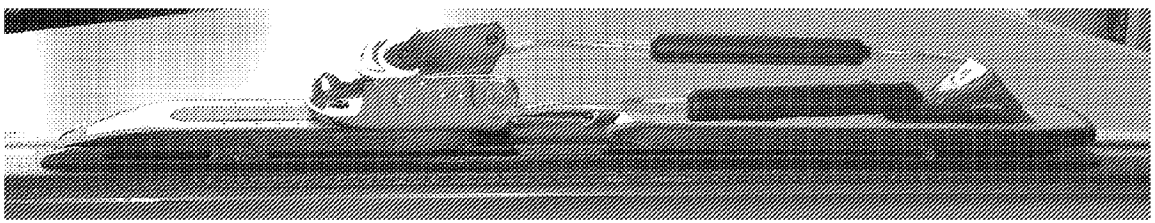

A prototype of an embodiment of the type illustrated in FIGS. 20*a* and *b* is shown in FIGS. 21 and 22. The prototype was constructed by modifying a Völkl 724 PRO ski with a Marker Piston Plate attached to the skis by rails so that it could accept the toepiece portion of a Rottefella COBRA R8 Telemark binding. Three holes were drilled in the Marker Piston Plate to correspond to the three screws normally used to affix the Rottefella toepiece to the Rottefella riser.

Claimed are:

1. A telemark ski binding comprising:

a toepiece sized and shaped to receive a telemark ski boot;

a coupler assembly comprising:

an upper coupler rotationally and translationally fixed relative to the toepiece regardless of torque; and a lower coupler that is:

substantially translationally fixed relative to the upper coupler regardless of torque; and rotationally fixed relative to the upper coupler such that:

rotation between the lower coupler and the upper coupler is permitted within a set angular range below a set threshold torque;

rotation between the lower coupler and the upper coupler from an angle within the set angular range to an angle outside the set angular range is resisted below the set threshold torque; and rotation between the lower coupler and the upper coupler is permitted at or above the set threshold torque; and an attachment device fixed to the lower coupler and so positioned as to permit the lower coupler to be rotationally and translationally fixed relative to a ski regardless of torque;

so that exposure of the ski binding to a torque at or above the set threshold torque causes the upper coupler and the lower coupler to decouple rotationally from one another without separating from one another, without causing the upper coupler to separate from the toepiece, and without causing the lower coupler to separate from the ski when attached to the ski.

2. The binding of claim 1 wherein said coupler assembly comprises a pin that is held by bias against the upper coupler, and a contour in the upper coupler that receives the pin.

3. The binding of claim 1 wherein the upper coupler comprises an engaging face, the lower coupler comprises an engaging face, and the engaging faces are so held to one another as to bias the upper coupler and lower coupler to a rotation orientation within the set angular range.

4. The binding of claim 1 wherein the attachment devices comprises at least one rail that is:

fixed with respect to the attachment device;

complementary to a longitudinally oriented track of a ski; and so sized and shaped as to be slidably displaceable relative to the track.

5. The binding of claim 1 wherein said coupler assembly comprises a wing-spring that is held by bias against the upper coupler, and a contour in the upper coupler that receives the wing-spring.

6. The binding of claim 2 wherein the upper coupler is contoured such that:

when the upper coupler and the lower coupler have rotationally decoupled from one another, the pin is so biased against the contour of the upper coupler as to tend to restore the upper coupler and/or the lower coupler to a rotation orientation within the set angular range.

7. The binding of claim 6 wherein said pin is oriented and biased substantially vertically.

8. The binding of claim 6 wherein said pin is oriented and biased substantially horizontally.

9. The binding of claim 6 wherein the contour of the upper coupler defines both a major axis and a minor axis and the major axis is greater than the minor axis.

10. The binding of claim 6 wherein the contour of the upper coupler is defined by a curve with a non-constant radius of curvature.

11. The binding of claim 3 wherein the engaging faces of the lower and upper couplers complement one another.

12. The binding of claim 5 wherein the upper coupler is contoured such that:

when the upper coupler and the lower coupler have rotationally decoupled from one another, then the wing-spring is so biased against the contour of the upper coupler as to tend to restore the upper coupler and/or the lower coupler to a rotation orientation within the set angular range.

13. The binding of claim 10 wherein the shape of the upper coupler is substantially a right elliptical cylinder;

the upper coupler comprises a concave depression in the curved side of the cylinder so shaped as to receive the pin; and the pin is oriented and biased substantially horizontally.

14. The binding of claim 11 wherein the engaging face of the upper coupler and the engaging face of the lower coupler are so sized and shaped that when the set threshold torque is not exceeded, the upper coupler is permitted to rotate within the set angular range relative to the lower coupler with substantially no translation relative to the lower coupler; and when the set threshold torque is exceeded, the upper coupler is permitted to rotate outside the set angular range relative to the lower coupler, and the upper coupler and lower coupler are permitted vertical translation relative to each other at least equal to the height of the complementary contours of the upper coupler and lower coupler.

15. The binding of claim 14 wherein the engaging face of the upper coupler is substantially convex and the engaging face of the lower coupler is substantially concave.

16. The binding of claim 14 wherein the engaging face of the upper coupler comprises a groove that has a curved shape and a sloping depth along a length of the groove.

17. A method of recovering from a skiing accident while wearing a ski coupled to a foot by the ski binding of claim 14, the method comprising:

holding the ski in mid-air in such a way that the upper coupler is located above the lower coupler, so that gravity tends to displace the couplers vertically from one another;

allowing the ski to return to center; and resuming skiing.

18. The binding of claim 16 wherein the engaging surface of the lower coupler comprises a ridge so sized and shaped as to be complementary to the groove in the engaging face of the upper coupler.

19. The binding of claim 16 wherein the engaging surface of the lower coupler comprises a post so sized and shaped as to be complementary to the groove in the engaging face of the upper coupler.

* * * * *